US009055777B2

(12) United States Patent
Chen

(10) Patent No.: US 9,055,777 B2
(45) Date of Patent: Jun. 16, 2015

(54) MODULAR ARTIFICIAL LIGHTED TREE WITH DECORATIVE LIGHT STRING

(71) Applicant: Willis Electric Co., Ltd, Taipei (TW)

(72) Inventor: Johnny Chen, Taipei (TW)

(73) Assignee: Willis Electric Co., Ltd., Taipei (TW)

( * ) Notice: Subject to any disclaimer, the term of this patent is extended or adjusted under 35 U.S.C. 154(b) by 152 days.

(21) Appl. No.: 13/962,084

(22) Filed: Aug. 8, 2013

(65) Prior Publication Data

US 2014/0036483 A1 Feb. 6, 2014

Related U.S. Application Data

(63) Continuation of application No. 13/112,749, filed on May 20, 2011, now Pat. No. 8,568,015.

(60) Provisional application No. 61/385,751, filed on Sep. 23, 2010.

(51) Int. Cl.

| | |
|---|---|
| ***F21S 4/00*** | (2006.01) |
| ***A41G 1/00*** | (2006.01) |
| ***F21V 33/00*** | (2006.01) |
| ***A47G 33/06*** | (2006.01) |
| ***H01B 17/00*** | (2006.01) |

(Continued)

(52) U.S. Cl.

CPC ..... *A41G 1/005* (2013.01); *Y10T 29/49117* (2015.01); *F21S 4/001* (2013.01); *F21V 21/002* (2013.01); *F21W 2121/04* (2013.01); *F21Y 2101/02* (2013.01); *F21V 33/00* (2013.01); *A47G 33/06* (2013.01); *F21V 23/06* (2013.01); *F21V 33/0028* (2013.01); *H01B 17/00* (2013.01); *A41G 1/007* (2013.01)

(58) Field of Classification Search

CPC ..... F21S 4/001–4/003; A47G 2033/0827; A41G 1/005; F21W 2121/04

See application file for complete search history.

(56) References Cited

U.S. PATENT DOCUMENTS

| | | | |
|---|---|---|---|
| 860,406 | A | 7/1907 | McGahan |
| 1,314,008 | A | 8/1919 | McWilliams |

(Continued)

FOREIGN PATENT DOCUMENTS

| | | | |
|---|---|---|---|
| CN | 2102058 | U | 4/1992 |
| CN | 2242654 | Y | 12/1996 |

(Continued)

OTHER PUBLICATIONS

Application and File History for U.S. Appl. No. 13/710,003, filed Dec. 10, 2012, inventor Chen.

(Continued)

*Primary Examiner* — Julie Bannan

(74) *Attorney, Agent, or Firm* — Christensen Fonder P.A.

(57) ABSTRACT

A decorative light string including a first group of light elements electrically connected in parallel to each other, a second plurality of light elements electrically connected in parallel to each other, and a third plurality of light elements electrically connected in parallel to each other. The first, second, and third groups of lights are electrically connected in series. A first wire stabilizer is located between the first group of lights and the second group of lights, and a second wire stabilizer is located between the second group of lights and the third group of lights. The first and second wire stabilizers secure wire ends forming first and second gaps in the wiring of the light string.

20 Claims, 11 Drawing Sheets

(51) Int. Cl.

| | |
|---|---|
| *F21V 21/002* | (2006.01) |
| *F21W 121/04* | (2006.01) |
| *F21Y 101/02* | (2006.01) |
| *F21V 23/06* | (2006.01) |

(56) References Cited

U.S. PATENT DOCUMENTS

| | | | |
|---|---|---|---|
| 1,536,332 | A | 5/1925 | Dam |
| 1,656,148 | A | 1/1928 | Harris |
| 1,677,972 | A | 7/1928 | Marks |
| 1,895,656 | A | 1/1933 | Gadke |
| 2,050,364 | A | 8/1936 | Morton |
| 2,072,337 | A | 3/1937 | Kamm |
| 2,188,529 | A | 3/1938 | Corina |
| 2,186,351 | A | 1/1940 | Stojaneck |
| 2,484,596 | A | 10/1949 | Waltz |
| 2,484,813 | A | 10/1949 | Waltz |
| 2,570,751 | A | 10/1951 | Benander |
| 2,636,069 | A | 4/1953 | Gilbert |
| 2,782,296 | A | 2/1957 | Walter |
| 2,806,938 | A | 9/1957 | Henry |
| 2,857,506 | A | 10/1958 | Minteer |
| 2,969,456 | A | 1/1961 | Raymaley |
| 2,984,813 | A | 5/1961 | Bossi |
| 3,115,435 | A | 12/1963 | Abramson |
| 3,118,617 | A | 1/1964 | Hellrich |
| 3,120,351 | A | 2/1964 | Kirsten |
| 3,214,318 | A | 10/1965 | Snow |
| 3,214,579 | A | 10/1965 | Pacini |
| 3,233,207 | A | 2/1966 | Ahroni et al. |
| 3,286,088 | A | 11/1966 | Ahroni |
| 3,296,430 | A | 1/1967 | Eckert |
| 3,345,482 | A | 10/1967 | Lou |
| 3,504,169 | A | 3/1970 | Freeburger |
| 3,522,579 | A | 8/1970 | Matsuya |
| 3,571,586 | A | 3/1971 | Duckworth |
| 3,574,102 | A | 4/1971 | Hermanson |
| 3,594,260 | A | 7/1971 | Smith |
| 3,603,780 | A | 9/1971 | Lu |
| 3,616,107 | A | 10/1971 | Kershner |
| 3,617,732 | A | 11/1971 | Fisher |
| 3,704,366 | A | 11/1972 | Korb et al. |
| 3,728,787 | A | 4/1973 | McDonough |
| 3,764,862 | A | 10/1973 | Jankowski |
| 3,783,437 | A | 1/1974 | Graff et al. |
| 3,806,399 | A | 4/1974 | Cocjin |
| 3,812,380 | A | 5/1974 | Davis, Jr. |
| 3,914,786 | A | 10/1975 | Grossi |
| 3,970,834 | A | 7/1976 | Smith |
| 3,985,924 | A | 10/1976 | Pritza |
| 4,012,631 | A | 3/1977 | Creager |
| 4,020,201 | A | 4/1977 | Miller |
| 4,045,868 | A | 9/1977 | Ammon et al. |
| 4,072,857 | A | 2/1978 | DeVicaris |
| 4,097,917 | A | 6/1978 | McCaslin |
| 4,109,345 | A | 8/1978 | Sargent et al. |
| 4,140,823 | A | 2/1979 | Weskamp |
| 4,161,768 | A | 7/1979 | Gauthier et al. |
| 4,203,476 | A | 5/1980 | Viterllaro |
| 4,248,916 | A | 2/1981 | Chase |
| 4,262,480 | A | 4/1981 | Wasserman et al. |
| 4,273,814 | A | 6/1981 | Koehler |
| 4,291,075 | A | 9/1981 | Puleo |
| 4,340,841 | A | 7/1982 | Schupp |
| 4,343,842 | A | 8/1982 | Chase |
| 4,437,782 | A | 3/1984 | Geisthoff |
| 4,447,279 | A | 5/1984 | Boisvert et al. |
| 4,451,510 | A | 5/1984 | Boisvert et al. |
| 4,462,065 | A | 7/1984 | Rhodes |
| 4,493,523 | A | 1/1985 | Leong et al. |
| 4,496,615 | A | 1/1985 | Huang |
| 4,516,193 | A | 5/1985 | Murphy |
| 4,546,041 | A | 10/1985 | Keane et al. |
| 4,573,102 | A | 2/1986 | Norwood |
| 4,620,270 | A | 10/1986 | Laakso |
| 4,628,547 | A | 12/1986 | Baker |
| 4,631,650 | A | 12/1986 | Ahroni |
| 4,659,597 | A | 4/1987 | Lau |
| 4,675,575 | A | 6/1987 | Smith et al. |
| 4,712,299 | A | 12/1987 | Loewen et al. |
| 4,720,272 | A | 1/1988 | Durand |
| 4,727,449 | A | 2/1988 | Fleck |
| 4,753,600 | A | 6/1988 | Williams |
| 4,769,579 | A | 9/1988 | Jou |
| 4,775,922 | A | 10/1988 | Engel |
| 4,777,573 | A | 10/1988 | Liao |
| 4,779,177 | A | 10/1988 | Ahroni |
| 4,789,570 | A | 12/1988 | Maddock |
| 4,805,075 | A | 2/1989 | Damore |
| 4,807,098 | A | 2/1989 | Ahroni |
| 4,808,885 | A | 2/1989 | Bausch et al. |
| 4,855,880 | A | 8/1989 | Mancusi, Jr. |
| 4,859,205 | A | 8/1989 | Fritz |
| 4,870,547 | A | 9/1989 | Crucefix |
| 4,870,753 | A | 10/1989 | Pfeffer et al. |
| 4,894,019 | A | 1/1990 | Howard |
| 4,899,266 | A | 2/1990 | Ahroni |
| 4,908,743 | A | 3/1990 | Miller |
| 4,934,964 | A | 6/1990 | Mazelle |
| 5,015,510 | A | 5/1991 | Smith |
| 5,033,976 | A | 7/1991 | Sarian et al. |
| 5,051,877 | A | 9/1991 | Liao |
| 5,071,362 | A | 12/1991 | Martens et al. |
| 5,073,132 | A | 12/1991 | Nottrott |
| 5,104,608 | A | 4/1992 | Pickering |
| 5,109,324 | A | 4/1992 | Ahroni |
| 5,121,310 | A | 6/1992 | Ahroni |
| 5,139,343 | A | 8/1992 | Lin |
| 5,149,282 | A | 9/1992 | Donato et al. |
| 5,154,508 | A | 10/1992 | Ahroni |
| 5,213,407 | A | 5/1993 | Eisenbraun |
| 5,217,382 | A | 6/1993 | Sparks |
| 5,218,233 | A | 6/1993 | Takahashi |
| 5,281,158 | A | 1/1994 | Lin |
| 5,342,661 | A | 8/1994 | Wilcox, II |
| 5,350,315 | A | 9/1994 | Cheng et al. |
| 5,366,386 | A | 11/1994 | Liao |
| 5,380,215 | A | 1/1995 | Huang |
| 5,389,008 | A | 2/1995 | Cheng et al. |
| 5,390,463 | A | 2/1995 | Sollner |
| D356,246 | S | 3/1995 | Adams |
| 5,442,258 | A | 8/1995 | Shibata |
| 5,453,664 | A | 9/1995 | Harris |
| 5,455,750 | A | 10/1995 | Davis et al. |
| 5,456,620 | A | 10/1995 | Kaminski |
| 5,481,444 | A | 1/1996 | Schultz |
| D367,257 | S | 2/1996 | Buelow et al. |
| 5,517,390 | A | 5/1996 | Zins |
| 5,518,425 | A | 5/1996 | Tsai |
| 5,536,538 | A | 7/1996 | Hartung |
| 5,541,818 | A | 7/1996 | Ng et al. |
| 5,550,720 | A | 8/1996 | Carroll |
| 5,559,681 | A | 9/1996 | Duarte |
| 5,560,975 | A | 10/1996 | Casper |
| D375,483 | S | 11/1996 | Tashiro |
| 5,580,159 | A | 12/1996 | Liu |
| 5,586,905 | A | 12/1996 | Marshall et al. |
| 5,605,395 | A | 2/1997 | Peng |
| 5,607,328 | A | 3/1997 | Joly |
| 5,624,283 | A | 4/1997 | Hotea |
| 5,626,419 | A | 5/1997 | Lin |
| 5,639,157 | A | 6/1997 | Yeh |
| 5,652,032 | A | 7/1997 | Kaczor et al. |
| 5,653,616 | A | 8/1997 | Hotea |
| 5,695,279 | A | 12/1997 | Sonnleitner |
| 5,702,262 | A | 12/1997 | Brown et al. |
| 5,702,268 | A | 12/1997 | Lien et al. |
| 5,707,136 | A | 1/1998 | Byers |
| 5,709,457 | A | 1/1998 | Hara |
| 5,720,544 | A | 2/1998 | Shu |
| 5,722,766 | A | 3/1998 | Shu |
| 5,727,872 | A | 3/1998 | Liou |
| 5,759,062 | A | 6/1998 | Chen |
| 5,775,933 | A | 7/1998 | Chen |

(56) References Cited

U.S. PATENT DOCUMENTS 5,776,559 A 7/1998 Woolford
5,785,412 A 7/1998 Wu et al.
5,788,361 A 8/1998 Lee
5,791,765 A 8/1998 Lin
5,791,940 A 8/1998 Chen et al.
5,807,134 A 9/1998 Hara
5,816,849 A 10/1998 Schmidt
5,816,862 A 10/1998 Tseng
5,820,248 A 10/1998 Ferguson
5,822,855 A 10/1998 Szczesny et al.
5,828,183 A 10/1998 Wang
5,829,865 A 11/1998 Ahroni
5,834,901 A 11/1998 Shen
5,839,819 A 11/1998 Pan
5,848,838 A 12/1998 Presta
5,852,348 A 12/1998 Lin
5,854,541 A 12/1998 Chou
5,855,705 A 1/1999 Gauthier
5,860,731 A 1/1999 Martinez
5,860,830 A 1/1999 Wu
5,869,151 A 2/1999 Chong
5,878,989 A 3/1999 Allman
5,893,634 A 4/1999 Wang
5,908,238 A 6/1999 Huang
5,915,827 A 6/1999 Wang
5,921,806 A 7/1999 Shuey
5,934,793 A 8/1999 Rahman
5,937,496 A 8/1999 Benoit et al.
5,938,168 A 8/1999 Adams
5,944,408 A 8/1999 Tong et al.
5,962,088 A 10/1999 Tanaka et al.
5,966,393 A 10/1999 Hide et al.
5,979,859 A 11/1999 Vartanov et al.
6,004,006 A 12/1999 Wang
6,030,670 A 2/2000 Chang
6,053,774 A 4/2000 Lin
6,056,427 A 5/2000 Kao
6,079,848 A 6/2000 Ahroni
6,084,357 A 7/2000 Janning
6,086,395 A 7/2000 Lloyd et al.
6,095,874 A 8/2000 Quaranta
6,099,920 A 8/2000 Kao
6,111,201 A 8/2000 Drane et al.
6,113,430 A 9/2000 Wu
6,116,563 A 9/2000 Tsai
6,120,312 A 9/2000 Shu
6,123,433 A 9/2000 Chen
6,126,298 A 10/2000 Wu
6,139,376 A 10/2000 Ooya et al.
6,147,367 A 11/2000 Yang et al.
6,155,697 A 12/2000 Ahroni
6,162,515 A 12/2000 Hill
6,203,169 B1 3/2001 Coushaine et al.
6,217,191 B1 4/2001 Wu et al.
6,245,425 B1 6/2001 McCullough et al.
6,257,736 B1 7/2001 Fehrenbach
6,257,740 B1 7/2001 Gibboney, Jr.
6,257,793 B1 7/2001 Lin
6,261,119 B1 7/2001 Green
6,273,584 B1 8/2001 Wang et al.
6,283,797 B1 9/2001 Wu
6,302,562 B1 10/2001 Wu
6,320,327 B1 11/2001 Lavatelli et al.
6,328,593 B1 12/2001 Chang et al.
6,347,965 B1 2/2002 Pan
D454,110 S 3/2002 Andre et al.
6,354,719 B1 3/2002 Pan
6,361,368 B1 3/2002 Tseng
6,363,607 B1 4/2002 Chen et al.
6,407,411 B1 6/2002 Wojnarowski et al.
6,452,317 B1 9/2002 Tseng
6,457,839 B1 10/2002 Grandoit
6,458,435 B1 10/2002 Lai
6,514,581 B1 2/2003 Gregory
6,533,437 B1 3/2003 Ahroni
6,536,916 B1 3/2003 Rahman
6,541,800 B2 4/2003 Barnett et al.
6,544,070 B1 4/2003 Radliff
6,559,385 B1 5/2003 Johnson et al.
6,571,340 B1 5/2003 Lee
6,572,064 B1 6/2003 Letson et al.
6,575,595 B1 6/2003 Wu
6,576,844 B1 6/2003 Kamata
6,580,182 B2 6/2003 Janning
6,588,914 B1 7/2003 Tang
6,592,094 B1 7/2003 Kao
6,595,657 B1 7/2003 Shieh
D478,310 S 8/2003 Andre et al.
6,609,814 B2 8/2003 Ahroni
6,623,291 B1 9/2003 Tsai
6,634,766 B1 10/2003 Gordon
6,644,836 B1 11/2003 Adams
D483,721 S 12/2003 Kim et al.
6,657,398 B2 12/2003 Chang
6,666,734 B2 12/2003 Fukatsu
6,672,750 B1 1/2004 Kao
D486,385 S 2/2004 Smith-Kielland et al.
6,733,167 B1 5/2004 Kao
6,752,512 B2 6/2004 Pan
6,774,549 B2 8/2004 Tsai et al.
6,794,825 B1 9/2004 Kao
6,805,463 B2 10/2004 Shieh
6,824,293 B2 11/2004 Chang
6,830,358 B2 12/2004 Allen
6,840,655 B2 1/2005 Shen
6,883,951 B2 4/2005 Wu
6,908,215 B2 6/2005 Wu
6,913,838 B2 7/2005 McCullough et al.
6,929,383 B1 8/2005 Janning
D509,797 S 9/2005 Milan
6,942,355 B1 9/2005 Castiglia
6,951,405 B2 10/2005 Yao
6,980,076 B1 12/2005 Rolling et al.
6,982,385 B2 1/2006 Wu
7,014,352 B2 3/2006 Wu
7,021,598 B2 4/2006 Kao
7,029,145 B2 4/2006 Frederick
7,045,965 B2 5/2006 Li et al.
7,052,156 B2 5/2006 Primeau
7,055,980 B2 6/2006 Wu
7,055,981 B2 6/2006 Yao
7,066,628 B2 6/2006 Allen
D530,277 S 10/2006 Lin
7,132,139 B2 11/2006 Yang
7,235,815 B2 6/2007 Wang
7,253,556 B1 8/2007 Gibboney
7,253,714 B1 8/2007 Tsui
7,264,392 B2 9/2007 Massabki et al.
7,270,450 B2 9/2007 Chan
7,393,019 B2 7/2008 Taga et al.
7,422,489 B1 9/2008 Tseng
D580,355 S 11/2008 Hussaini et al.
7,445,824 B2 11/2008 Leung et al.
7,453,194 B1 11/2008 Gibboney
D582,846 S 12/2008 Lett
D585,384 S 1/2009 Andre et al.
7,473,024 B2 1/2009 Gibboney
7,547,843 B2 6/2009 Deve et al.
7,554,266 B1 6/2009 Chen
D598,374 S 8/2009 Sasada
7,575,362 B1 8/2009 Hsu
7,581,870 B2 9/2009 Massabki et al.
7,585,552 B2 9/2009 Meseke
7,609,006 B2 10/2009 Gibboney
D608,685 S 1/2010 Krize
D609,602 S 2/2010 Krize
D611,409 S 3/2010 Green et al.
7,695,298 B2 4/2010 Arndt et al.
D620,836 S 8/2010 Chen et al.
7,772,495 B2 8/2010 Wu et al.
7,893,627 B2 2/2011 Li
D638,355 S 5/2011 Chen
8,007,129 B2 8/2011 Yang
8,053,042 B1 11/2011 Loomis

(56) References Cited

U.S. PATENT DOCUMENTS

| | | | | |
|---|---|---|---|---|
| 8,062,718 | B2 | 11/2011 | Schooley | |
| 8,100,546 | B2 | 1/2012 | Lutz et al. | |
| 8,132,360 | B2 | 3/2012 | Jin et al. | |
| 8,132,649 | B2 | 3/2012 | Rogers | |
| 8,298,633 | B1 | 10/2012 | Chen | |
| 8,348,466 | B2 | 1/2013 | Plumb et al. | |
| 8,371,028 | B2 | 2/2013 | Goldsworthy et al. | |
| D678,211 | S | 3/2013 | Chen | |
| 8,450,950 | B2 | 5/2013 | McRae | |
| 8,469,750 | B2 | 6/2013 | Chen | |
| D686,523 | S | 7/2013 | Chen | |
| 8,569,960 | B2 | 10/2013 | Chen | |
| D696,153 | S | 12/2013 | Chen | |
| 2002/0097573 | A1* | 7/2002 | Shen | 362/123 |
| 2002/0109989 | A1 | 8/2002 | Chuang | |
| 2002/0118540 | A1 | 8/2002 | Ingrassia | |
| 2002/0149936 | A1 | 10/2002 | Mueller et al. | |
| 2003/0096542 | A1 | 5/2003 | Kojima | |
| 2003/0142494 | A1 | 7/2003 | Ahroni | |
| 2003/0198044 | A1 | 10/2003 | Lee | |
| 2003/0198048 | A1 | 10/2003 | Frederick | |
| 2003/0206412 | A1 | 11/2003 | Gordon | |
| 2003/0218412 | A1 | 11/2003 | Shieh | |
| 2004/0004435 | A1 | 1/2004 | Hsu | |
| 2004/0012950 | A1 | 1/2004 | Pan | |
| 2004/0090770 | A1 | 5/2004 | Primeau | |
| 2004/0096596 | A1 | 5/2004 | Palmer, III et al. | |
| 2004/0105270 | A1 | 6/2004 | Shieh | |
| 2004/0115984 | A1 | 6/2004 | Rudy et al. | |
| 2004/0145916 | A1 | 7/2004 | Wu | |
| 2004/0182597 | A1 | 9/2004 | Smith et al. | |
| 2005/0048226 | A1 | 3/2005 | Gary et al. | |
| 2005/0077525 | A1 | 4/2005 | Lynch et al. | |
| 2005/0122723 | A1 | 6/2005 | Frederick | |
| 2005/0249892 | A1 | 11/2005 | Rocheleau | |
| 2005/0286267 | A1 | 12/2005 | Wang | |
| 2006/0000634 | A1 | 1/2006 | Arakawa | |
| 2006/0146578 | A1 | 7/2006 | Kao | |
| 2006/0164834 | A1 | 7/2006 | Kao | |
| 2006/0270250 | A1 | 11/2006 | Allen | |
| 2006/0274556 | A1 | 12/2006 | Massabki et al. | |
| 2007/0092664 | A1 | 4/2007 | Chun | |
| 2007/0177402 | A1 | 8/2007 | Wu | |
| 2007/0230174 | A1* | 10/2007 | Hicks et al. | 362/252 |
| 2007/0253191 | A1 | 11/2007 | Chin et al. | |
| 2008/0007951 | A1 | 1/2008 | Chan | |
| 2008/0025024 | A1 | 1/2008 | Yu | |
| 2008/0107840 | A1 | 5/2008 | Leung et al. | |
| 2008/0186731 | A1 | 8/2008 | Graham | |
| 2008/0186740 | A1 | 8/2008 | Huang et al. | |
| 2008/0205020 | A1 | 8/2008 | Vich | |
| 2008/0296604 | A1 | 12/2008 | Chou et al. | |
| 2008/0303446 | A1 | 12/2008 | Ding | |
| 2008/0307646 | A1 | 12/2008 | Zaderej et al. | |
| 2009/0002991 | A1 | 1/2009 | Huang | |
| 2009/0059578 | A1 | 3/2009 | Lau | |
| 2009/0213620 | A1 | 8/2009 | Lee | |
| 2009/0260852 | A1 | 10/2009 | Schaffer | |
| 2009/0289560 | A1 | 11/2009 | Oliva | |
| 2009/0308637 | A1 | 12/2009 | Amils | |
| 2010/0000065 | A1 | 1/2010 | Cheng et al. | |
| 2010/0053991 | A1 | 3/2010 | Boggs | |
| 2010/0067242 | A1 | 3/2010 | Fung | |
| 2010/0072747 | A1 | 3/2010 | Krize | |
| 2010/0195332 | A1 | 8/2010 | Wasem | |
| 2010/0196628 | A1 | 8/2010 | Shooley | |
| 2010/0263911 | A1 | 10/2010 | Watanabe | |
| 2011/0062875 | A1 | 3/2011 | Altamura | |
| 2011/0076425 | A1 | 3/2011 | Cheng et al. | |
| 2011/0100677 | A1 | 5/2011 | Chen et al. | |
| 2011/0215368 | A1 | 9/2011 | Chen | |
| 2011/0245824 | A1 | 10/2011 | Schaffer | |
| 2011/0286223 | A1 | 11/2011 | Chen | |
| 2011/0303939 | A1 | 12/2011 | Chen | |
| 2011/0305022 | A1 | 12/2011 | Chen | |
| 2012/0009360 | A1 | 1/2012 | Fu et al. | |
| 2012/0075863 | A1 | 3/2012 | Chen | |
| 2012/0076957 | A1 | 3/2012 | Chen | |
| 2012/0236546 | A1 | 9/2012 | Chen | |
| 2013/0059094 | A1 | 3/2013 | Chen | |
| 2013/0301245 | A1 | 11/2013 | Chen | |
| 2013/0301246 | A1 | 11/2013 | Chen | |
| 2013/0301247 | A1 | 11/2013 | Chen | |
| 2013/0308301 | A1 | 11/2013 | Chen | |
| 2014/0049168 | A1 | 2/2014 | Chen | |
| 2014/0049948 | A1 | 2/2014 | Chen | |
| 2014/0268689 | A1 | 9/2014 | Chen | |
| 2014/0287618 | A1 | 9/2014 | Chen | |
| 2014/0334134 | A1 | 11/2014 | Loomis | |

FOREIGN PATENT DOCUMENTS

| | | | |
|---|---|---|---|
| CN | 1181693 | | 5/1998 |
| CN | 2332290 | Y | 8/1999 |
| CN | 2484010 | Y | 4/2002 |
| CN | 1509670 | | 7/2004 |
| CN | 2751226 | Y | 1/2006 |
| CN | 201187701 | | 1/2009 |
| DE | 8436328 | | 4/1985 |
| DE | 10235081 | | 2/2004 |
| EP | 0 298 518 | | 3/1993 |
| EP | 0552741 | | 7/1993 |
| EP | 0727842 | | 8/1996 |
| EP | 2 436 808 | | 4/2012 |
| GB | 1150390 | | 4/1969 |
| GB | 1245214 | | 9/1971 |
| GB | 2137086 | | 10/1984 |
| GB | 2172135 | | 9/1986 |
| GB | 2396686 | | 6/2004 |
| JP | 11121123 | A | 4/1999 |
| WO | WO 91/10093 | | 7/1991 |
| WO | WO 96/24966 | | 8/1996 |
| WO | WO 9626661 | A1 | 9/1996 |
| WO | WO 2007140648 | A1 | 12/2007 |
| WO | WO 2009/115860 | A1 | 9/2009 |

OTHER PUBLICATIONS

U.S. Appl. No. 90/020,074, filed Jul. 14, 2014, Patent No. 8,454,187.

U.S. Appl. No. 90/020,073, filed Jul. 7, 2014, Patent No. 8,454,186.

Inter Partes Review of USPN 8,454,187, Case No. IPR2014-01264, filed Aug. 8, 2014.

Petition for Inter Partes Review of USPN 8,454,186, Case No. IPR2014-01263, filed Aug. 8, 2014.

Application and File History for U.S. Appl. No. 13/112,650, filed May 20, 2011, inventor Johnny Chen.

Application and File History for U.S. Appl. No. 13/112,749, filed May 20, 2011, inventor Johnny Chen.

Application and File History for U.S. Appl. No. 13/461,432, filed May 1, 2012, inventor Johnny Chen.

Application and File History for U.S. Appl. No. 13/718,028, filed Dec. 18, 2012 inventor Johnny Chen.

* cited by examiner

P1
P2
PM
G1
GM-1
314
316
312
318
310
+V-
I
LE1,1
LE1,2
LE1,N
LE2,1
LE2,2
LE2,N
LEM,1
LEM,2
LEM,N
I1,1
I1,2
I1,N
I2,1
I2,2
I2,N
IM
VLE1
VLE2
VLEM

P1
P2
P3
G1
G2
116
3v
0v
9v
6v
310
+9V-

MODULAR ARTIFICIAL LIGHTED TREE WITH DECORATIVE LIGHT STRING

RELATED APPLICATIONS

The present application is a continuation application of U.S. patent application Ser. No. 13/112,749 filed on May 20, 2011 which claims priority to U.S. Provisional Application No. 61/385,751 filed on Sep. 23, 2010 and entitled ARTIFICIAL PRE-LIT TREE WITH MODULAR DIRECT-CURRENT LIGHTING SYSTEM, which are herein incorporated by reference in their entireties.

FIELD OF THE INVENTION

The present invention is generally directed to decorative lighting. More specifically, the present invention is directed to decorative light strings for lighted artificial trees.

BACKGROUND OF THE INVENTION

Most decorative light strings are series-parallel light strings having multiple groups of series-connected lights connected together in parallel. In a series-parallel string, the voltage at each light is the source voltage divided by the number of lights in the series group. For example, one commonly-used decorative light string includes two groups of 50 lights connected in series to form a 100-count light string. When connected to a 120 VAC source, the voltage at each bulb of a 50-bulb series group is approximately 2.4 VAC. Because of the series construction, if any one light in the series group fails, all lights in the series group lose power.

Typically, such light strings include a power plug at one end and a power receptacle, also referred to as an end connector, at the opposite end, for connecting light strings end-to-end. The power plug typically includes a pair of wires, a lead wire and a return wire, contacting a pair of terminals for plugging into a power source. The power plug may also include an additional power receptacle on the back of the power plug so that multiple plugs may be powered at the same power outlet by plugging one plug into another.

The lead wire of the power plug connects to the first light in the series group. Multiple short sections of wire connect individual lights in series. Each end of the short wire is stripped of insulation, crimped to a conducting terminal, and inserted into a lamp holder, The long return wire extends the length of the series group, intertwined with the shorter wires, and connects at the last light. Most lamp holders of the series group receive two wires to wire the individual light in series, while the first and last lamp holders of each series receive three wires. A second series group may be added to the first, and an additional wiring connections may be made to add 10 the power receptacle at the end of the series.

Most pre-lit artificial trees include multiple light strings of this common series-parallel connected end-to-end, or by stacking plugs. Modem pre-lit artificial trees may include as many as 1,000 or 1,500 lights, or ten to fifteen 100-light strings, with the actual number varying depending on tree size, desired lighting density, and so on. With the large number of lights and light strings, it can be difficult to find and then properly connect the necessary plugs in order to power all of the light strings on the tree. Light strings may be connected to one another within a given tree section, or sometimes between sections, by connecting the strings end to end or by stacking plugging. Short extension cords may be strung along the outside of the trunk to carry power to the various interconnected light strings. The result is a complex web of lighting that often requires a consumer to not only interconnect the plugs and receptacles of individual light strings together, but to stack and plug multiple light strings and cords into multiple power outlets.

SUMMARY OF THE DISCLOSURE

The present invention is directed to light strings and lighting systems for lighted artificial trees that reduce the complexity of light string assembly, simplify the electrical connections of the light strings at the tree, and limit the effect of individual lighting element failure. In one embodiment, the present invention comprises a decorative light string. The light string comprises a first wire including a first end and a first conductor, a second wire including a second conductor, the second wire adjacent the first wire and defining a first conductor gap. The light string also comprises a first plurality of light assemblies, each light assembly including a light element having a first lead and a second lead, the first lead in electrical connection with the first conductor and the second lead in electrical connection with the second conductor such that all of the light elements of the first plurality of light assemblies are electrically connected in parallel to one another; and a second plurality of light assemblies, each lighting assembly including a light element having a first lead and a second lead, the first lead in electrical connection with the first conductor and the second lead in electrical connection with the second conductor such that all of the light elements of the second plurality of light assemblies are electrically connected in parallel to one another. A first wire stabilizer is affixed to the first wire and to the second wire, at the first end of the first wire, and a second wire stabilizer is affixed to the first wire and the second wire at the first conductor gap of the second wire, the first conductor gap located between the first plurality of light assemblies and the second plurality of light assemblies. The first plurality of light assemblies is electrically connected in series to the second plurality of lighting assemblies.

In another embodiment, the present invention comprises a lighted artificial tree that includes a trunk portion having a plurality of branches, a first power conductor and a second power conductor, and a parallel-series light string supported by at least a portion of the plurality of branches. The light string includes a first wire adjacent a second wire, a first light group comprising a first plurality of light assemblies electrically connected to the first wire and the second wire and electrically connected to each other in parallel, and a second light group comprising a second plurality of light assemblies electrically connected to the first wire and the second wire and electrically connected to each other in parallel. The second light group forms an electrically series connection to the first light group. The light string also includes a wire stabilizer receiving a portion of the first wire and a portion of the second wire between the first light group and the second light group, the wire stabilizer enclosing a gap in the first wire.

In yet another embodiment, the present invention comprises a wire stabilizer for stabilizing a first interrupted wire defining a wire gap and a second wire adjacent to the first wire. The wire stabilizer includes a bottom portion defining a wire-receiving channel receiving a first interrupted wire having a first end and a second end and defining a wire gap between the first end and the second end, and receiving a second continuous wire adjacent the first wire wire. The wire stabilizer also includes a top portion connectable to the bottom portion and including a first wire-clamping projection and a gap-filling projection. The first wire-clamping projection secures a portion of the first wire and the second wire in the wire-receiving channel and the gap filling projection extends between the first end and the second end of the first wire when the bottom portion and the top portion are connected together in a closed position.

The above summary of the various representative embodiments of the invention is not intended to describe each illustrated embodiment or every implementation of the invention. Rather, the embodiments are chosen and described so that others skilled in the art can appreciate and understand the principles and practices of the invention. The figures in the detailed description that follow more particularly exemplify these embodiments.

BRIEF DESCRIPTION OF THE FIGURES

The invention can be understood in consideration of the following detailed description of various embodiments of the invention in connection with the accompanying drawings, in which.

Figure 1:
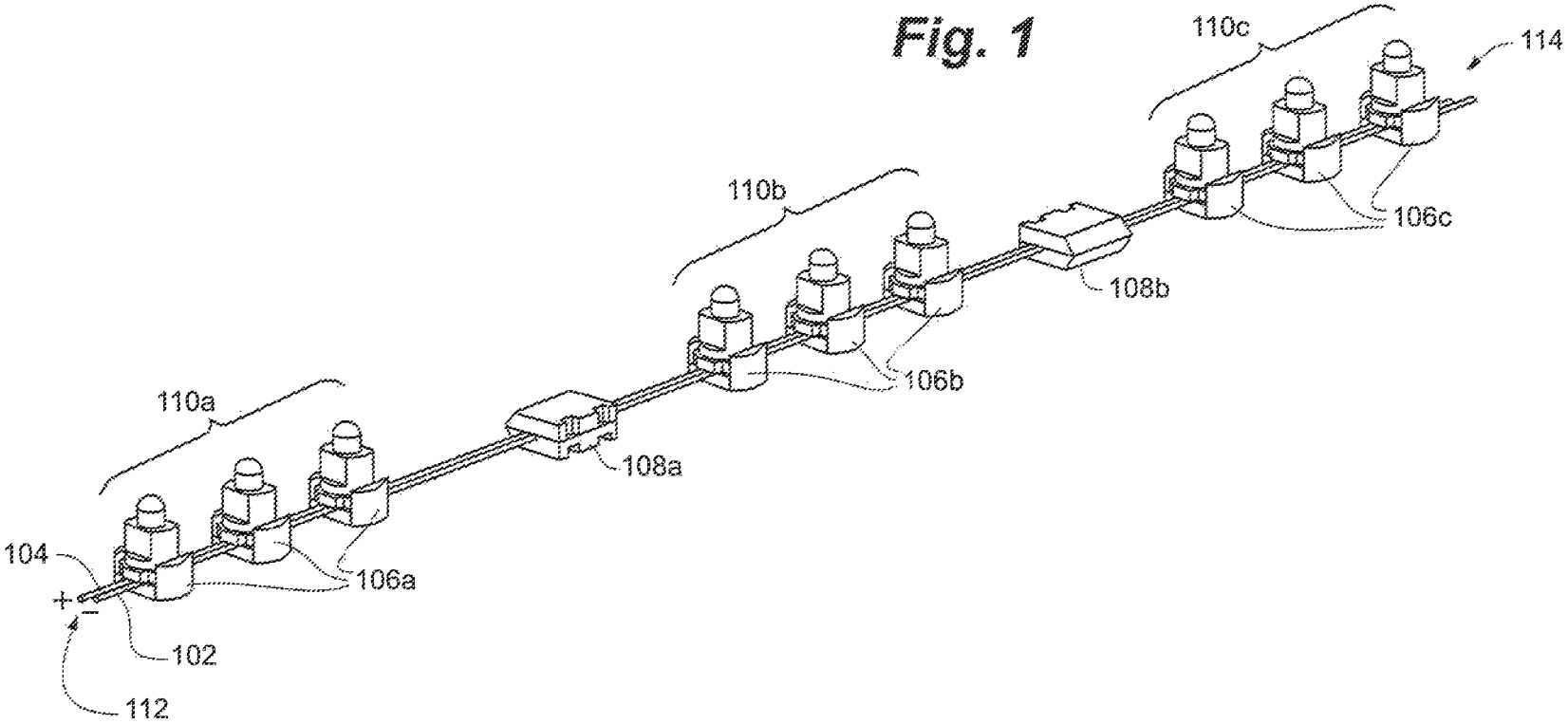
FIG. 1 is a front perspective view of a decorative light string of the present invention, according to an embodiment of the present invention.

While the invention is amenable to various modifications and alternative forms, specifics thereof have been shown by way of example in the drawings and will be described in detail, It should be understood, however, that the intention is not to limit the invention to the particular embodiments described. On the contrary, the intention is to cover all modifications, equivalents, and alternatives failing within the spirit and scope of the invention as defined by the appended claims.

DETAILED DESCRIPTION

Referring to FIG. 1, an embodiment of light string 100 adapted for use with artificial light trees of the present invention is depicted. As depicted, light string 100 includes a pair of side-by-side wires, wire 102 and 104, multiple light assemblies 106 and multiple wire stabilizers 108, including wire stabilizers 108*a* and 108*b*. Lighting assemblies 106 are grouped to form multiple light groups 110, including light group 110*a*, 110*b*, and 110*c*. Although not depicted in FIG. 1, as explained further below, light string 100 may also include one or more electrical connectors, including an electrical connector at a proximal end 112 of light string 100, or at a distal end 114. Alternatively, although not depicted, additional wire stabilizers 108 may be used at the proximal and/or distal of light string 100 to stabilize wires 102 and 104, with or without additional electrical connectors.

Lighting assemblies 106 within each light group 110 are powered through, and connected electrically to, wires 102 and 104. Wires 102 and 104 are electrically connected to a power source providing power to one or more light strings 100 of a lighted tree, and include a conductor portion surrounded by an insulated portion as will be understood by those skilled in the art.

Light assemblies 106 are also electrically connected in parallel with each other, within their respective light group 110. Light group 110*a* includes three light assemblies 106*a* connected in parallel; light group 110*b* includes three light assemblies 106*b* electrically connected in parallel; and light group 110*c* includes three light assemblies 106*c* electrically connected in parallel. It will be understood that although each light group 110*a*, 110*b*, and 110*c* is depicted as including only three lighting elements 106, a light group 110 may include any number of lighting elements 106, limited only by practical current-carrying limitations of wires 102 and 104 and the desired numbers of 15 lighting assemblies 106 on light string 100.

Similarly, although only three light groups 110, 112, and 114 are depicted in FIG. 1, as will be explained further below, light string 100 of the present invention may generally include more light groups than three. The number of overall light assemblies 106 and light groups 110 will ultimately be determined by a number of factors including desired tree-light density, available tree voltage, and other such factors.

Each lighting group 110 is electrically connected to the other in series through wirestabilizers 108, such that light string 100 is a parallel-series light string. In typical decorative light strings applied to artificial pre-lit trees, the light strings are series-parallel light strings. Multiple lights are wired together in series to form a series group, and each series group is wired in parallel to form the series-parallel light string. However, such light strings fail to benefit from parallel wiring of individual lights, require long source and return wires, and demand significant effort to assemble. Unlike traditional series-parallel light strings, light string 100 comprises a parallel-series light string, i.e., multiple parallel-connected light assemblies 106 forming a group 110, and multiple series-connected groups 110, the construction and benefits of which are described further below.

Figure 3B:
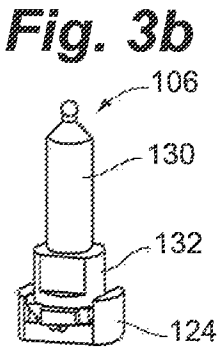
FIG. 3*b* is a front perspective view of the light assembly of FIG. 3*a;*
Figure 4:
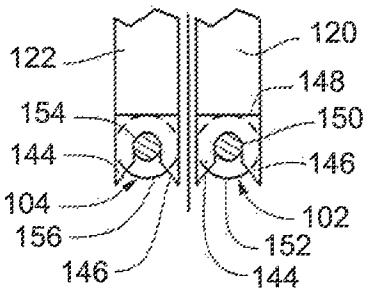
FIG. 4 is a front view of wire-piercing terminals piercing wires of the light string of FIG. 1.
Figure 2A:
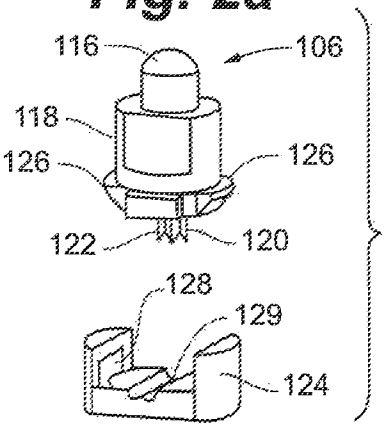
FIG. 2*a* is an exploded, front perspective view of an embodiment of a light assembly of the light string of FIG. 1.

Referring to FIGS. 2*a* to 4, embodiments of light assembly 106 are depicted. FIGS. 2*a* and 2*b* depict a light emitting diode (LED)-based light assembly 106, while FIGS. 3*a* and 3*b* depict an incandescent lamp-based lighting assembly 106. FIG. 4 depicts a pair of wire-piercing leads of a light assembly 106, which may correspond to any type of light assembly 106, including the LED-based light assembly 106 of FIGS. 2*a* and 2*b*, or the incandescent-lamp-based light assembly 106 as depicted in FIGS. 3*a* and 3*b*.

Referring specifically to FIG. 2*a*, LED-based light assembly 106 in a partially-exploded view is depicted. LED-based light assembly 106 includes light element 116, comprising an LED, base 118, first wire-piercing lead 120, second wire-piercing lead 122 and socket 124.

Light element 116, an LED in this embodiment, may comprise one or more LEDs and may include other electrical components. In one embodiment, light element 118 comprises a single LED chip, while in another embodiment, light element 118 comprises multiple LEDs emitting light at different frequencies. Light element 118 may also include a lens surrounding the LED, a chip carrier, and an LED lead frame with a pair of leads.

Base 118 supports light element 116 and wire-piercing leads 120 and 122. Base 118 may be comprise a plastic material and be formed by injection molding. In one embodiment, base 118 is injection molded around light element 116 to form an integrated base and light element. In other embodiments, base 118 is molded separately, and light assembly 116 is inserted by assembly methods into base 118.

Base 118 may include structural elements for securing wires 102 and 104 (not depicted) to lighting assembly 106, including wire channels similar to those of socket 124. Base 118 may also include structural elements for securing base 118 to socket 124, including shoulders 126.

Socket 124 is adapted to receive base 118, light element 116 and first and second. wirepiercing leads 120 and 124. in an embodiment, socket 124 includes a pair of recesses 128 (only one depicted) for receiving shoulders 126 of base 118 to secure base 118 to socket 124. Socket 124 also includes a pair of wire channels 129 for receiving wires 102 and 104 (see FIG. 1).

Figure 2B:
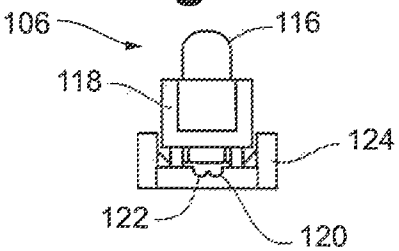
FIG. 2*b* is a front view of the assembled light assembly of FIG. 2*a;*

Referring to FIG. 2*b*, a front view of an assembled light assembly 106 as described above with respect to FIG. 2*a* is depicted. Light element 116 is retained by base 118, which is coupled to base 124. As described further below with respect to FIG. 4, leads 120 and 122 extend into wire channels pair 129, and through wires 102 and 104, respectively. In an embodiment, leads 120 and 120 are integral to a lead frame of LEI) 102. Such an embodiment is depicted and described in U.S. application Ser. No. 13/042,171, filed Mar. 7, 2011, entitled "LIGHT-EMITTING DIODE WITH WIRE-PIERCING LEAD FRAME", commonly assigned to the assignee of the present application, and herein incorporated in its entirety.

Figure 3A:
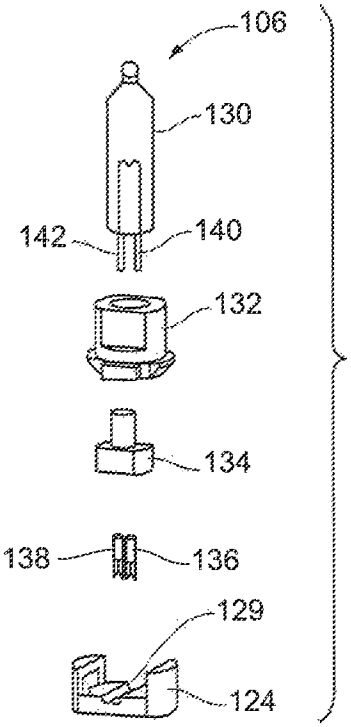
FIG. 3*a* is an exploded, front perspective of another embodiment of a light assembly of a light string of the present invention.

Referring to FIG. 3*a*, an exploded view of an incandescent-lamp-based light assembly 106 is depicted. In this embodiment, light assembly 106 includes an incandescent lamp 130, base 132, lead guide 134, first wire-piercing lead 136, second wire-piercing lead 138, and socket 124. Referring also to FIG. 3*b*, in this embodiment, bulb 130, lead guide 134, and leads 136 and 138 are coupled together lead within base 132 and lead guide 134. Wires 140 and 142 of incandescent bulb 130 are in electrical connection with separable wire-piercing leads 136 and 138, respectively, the assembly is then coupled to socket 124 and wires 102 and 104, such that wires 102 and 104 are electrically connected to wires 140 and 142. through wire-piercing leads 136 and 138 (refer also to FIG. 4).

Referring to FIG. 4, in an embodiment, lead 120 makes an electrical connection with conductor wire 102 and lead 122 makes an electrical connection with wire 104. In this embodiment, each lead 120 and 122 includes left cutting portion 144 and right cutting portion 146, and shoulder 148. Wire 102 includes conductor portion 150 and insulation portion 152, and wire 104 includes conductor portion 154 and insulation portion 156.

Cutting portions 144 and 146 of lead 120 cut through, or pierce, insulation 152 of wire 102, making contact with conductor 150, thus forming an electrical connection between wire 102 and first lead 120. Conductor 150 generally seats into a curved portion of lead 120, while insulation 152 is adjacent shoulder 148. During an assembly process, wires 102 and 104 may be received by the wire channels of socket 124, and the remaining elements of light assembly 106 are pressed downward into socket 124, causing lead 120 to pierce wire 102. Shoulders 148 in leads 120 and 122 provide a stop against insulation 152 of wire 102 to assist in preventing leads 120 and 122 from moving too far relative to wires 102 and 104, thereby assisting in properly positioning the leads relative to the wires, and ensuring adequate electrical connection.

Similarly, cutting portions 144 and 146 of lead 122 pierce insulation 156 of wire 104, causing conductor 154 of wire 104 to make contact, thereby creating an electrical connection between lead 122 and wire 104.

Although depicted as wire-piercing leads, it will be understood that in other embodiments, leads 120 and 122 may not be "wire-piercing", but may comprise other structural forms that are adapted to make electrical contact with wires 102 and 104. In one such alternate embodiment, leads 102 and 122 are needle-like and puncture insulation of wires 102 and 104 to form an electrical connection with conductors 150 and 154. In another alternate embodiment, portions of insulation 152 and 156 are removed from wires 102 and 104, respectively, and leads 120 and 122 extending through base 118 or 132 make contact with conductors 150 and 154.

It will be understood that although light assemblies 106 have been described as having an embodiment with an LED 116 and an embodiment with an incandescent bulb 130, the present invention is not limited to LEDs and incandescent bulbs, but may include other lighting elements.

Figure 5:
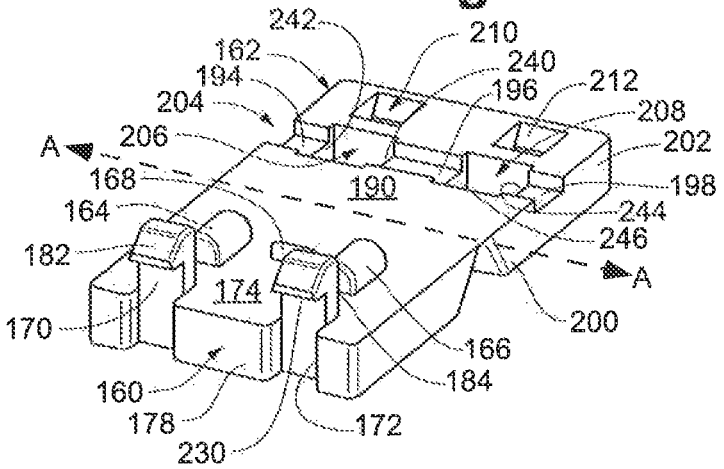
FIG. 5 is a top perspective view of an embodiment of a wire stabilizer of the light string of FIG. 1, in an open position.
Figure 6:
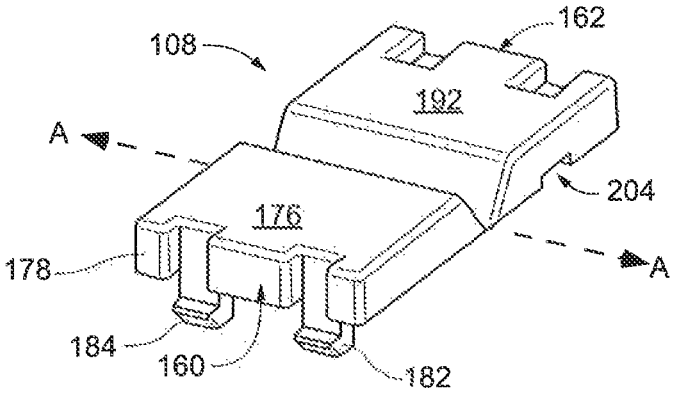
FIG. 6 is a bottom perspective view of the wire stabilizer of FIG. 5, in an open position.
Figure 7A:
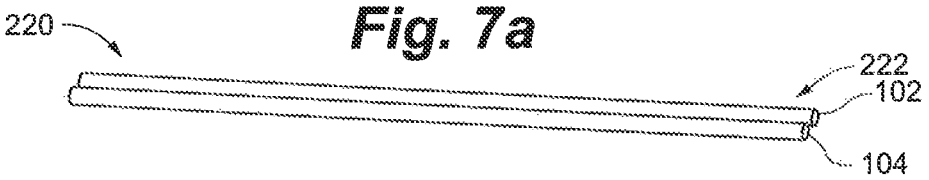
FIG. 7*a* is a perspective view of a pair of wires of the light string of FIG. 1.
Figure 7B:
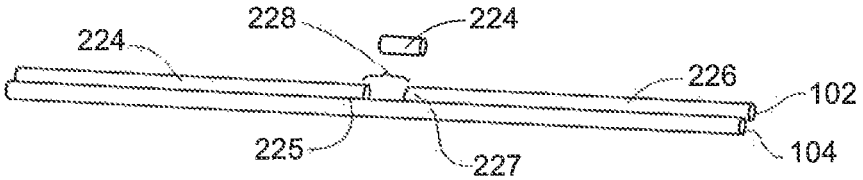
FIG. 7*b* is a perspective view of the pair of wires of the light string of FIG. 7*a*, with one wire having a cutout.
Figure 8:
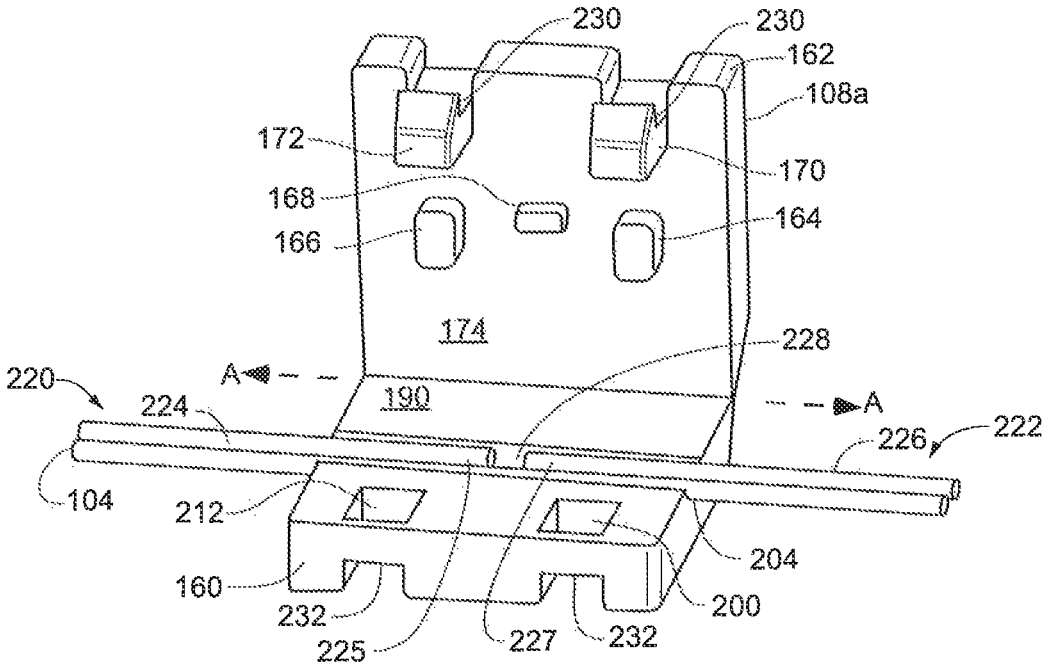
FIG. 8 is a front perspective view of the pair of wires of FIG. 7*b* inserted into the wire stabilizer of FIGS. 5 and 6, the wire stabilizer in a partially open position.

Referring to FIGS, 5-9, an embodiment of wire stabilizer 108, and of side-by-side wires 102 and 104, depicted in various views is depicted. FIG. 5 depicts a wire stabilizer 108 in an open position, without wires 102 and 104. FIG. 6 depicts a bottom view of the wire stabilizer 108 of FIG. 5. FIGS. 7*a* and 7*b* depict wires 102 and 104 before and after a section of wire 102 is removed. FIG. 8 depicts wire stabilizer 108 in a partially open position with wires 102 and 104 received by wire stabilizer 108. FIG. 9 depicts a cross-section of wire stabilizer 108 stabilizing wires 102 and 104.

Referring specifically to FIGS. 5 and 6, and embodiment of wire stabilizer 108 in an open position is depicted. Wire stabilizer 108 in the embodiment depicted generally comprises a boxlike structure that folds or hinges along horizontal axis A. In the depicted embodiment, wire stabilizer comprises top portion 160 and bottom portion 162 folding about axis A. In other embodiments, top portion 160 and bottom portion 162 may be separable portions that clip together at opposing sides, rather than fold or bend about axis A.

Top portion 160 includes first wire-clamping projection 164, second wire-clamping projection 166, gap-filling projection 168, first clip projection 170 second clip projection 172, inner surface 174, outer surface 176, outer end 178, and inner end 180. First wire-clamping projection 164 and second wire-clamping projection 166 project generally perpendicularly away from inner surface 174 and spaced apart with gap-filling projection 168, also projecting from inner surface 174, between them. In the depicted embodiment, projections 164, 166 and 16$ are distinct projections extending separately from inner surface 174, while in other embodiments, projections 164, 166, and 168 may form a single, integral projection extending substantially the same distance away from surface 174 for the length of the projection. In other embodiments, a single, integral projection extends away from surface 174 in an uneven manner to form distinct projections along the integral projection.

Wire-clamping projections 164 and 166 may form rounded or arcuate ends so as to avoid corners or sharp angles that might press sharply against wires 102 and 104 when wire stabilizer 108 is in a closed position (described further below with respect to FIGS. 8 and 9), In other embodiments, the ends of wire-clamping projections 164 and 166 may define other shapes, even shapes deliberately meant to press sharply against wires 102 and 104 to provide added stability.

First clip projection 170 and second clip projection 172 project in a direction generally perpendicular to inner surface 174 at outside end 178, and in an embodiment, include head. sections 182 and 184, respectively, that extend in a direction parallel to inner surface 174 and outside surface 176.

Bottom portion 162 includes inner surface 190, outer surface 192, first channel surface 194, center channel surface 196, second channel surface 198, inside end 200, and outside end 202. Bottom portion 162 defines wire channel 204, first wire-clamping recess 206, second wireclamping recess 208, first clip projection receiver 210 and second clip projection receiver 212.

Inner surface 190 comprises a generally flat, planar surface on both sides of wire channel 204. In the embodiment depicted, surfaces 194, 196, and 198 may be generally coplanar to one another, and in a plane generally parallel to surface inner surface 190.

Wire channel 204 extends the width of bottom portion 162 and is sized to receive portions of wires 102 and 104 (not depicted in FIGS. 5 and 6). Wire-clamping recesses 206 and 208 are sized to receive portions of wire-clamping projections 164 and 166, respectively when wire stabilizer 108 is folded about axis A.

Referring to FIGS. 7*a* and 7*b*, wires 102 and 104, each having a proximal end 220 and a distal end 222 are depicted. FIG, 7*a* depicts a portion of wires 102 and 104 prior to removing a small section of one of the wires. FIG. 7*b* depicts wire portion 224 removed from wire 102 to form wire gap 228. By removing wire portion 224, wire 102 includes a proximal portion 228 and distal portion 230, The electrical continuity between proximal end 220 and distal end 222 is 10 broken when wire 102 and its conductor 150 are interrupted by gap 228. A gap end 225 of proximal portion 224 and a gap end 227 of distal portion 226 are separated by gap 228.

In the embodiment depicted, both the conductor portion 150 and the insulation portion 152 of wire 102 are interrupted by the removal of wire portion 224 creating gap 228. In such an embodiment, gap ends 225 and 227 remain uncovered such that portions of conductor 150 remain exposed at each gap end. In one embodiment, wire portion 224 is punched out from wire 102 using automated techniques.

In FIGS. 7*a* and 7*b*, wire 104 remains intact such that electrical connection between proximal end 220 and distal end 222 is maintained.

As will be discussed further below, generally, for every gap 228 created, a wire stabilizer 20 108 is attached to wires 102 and 104 at gap 228. Further, and as also explained below, wire portions 224 are alternately removed from wires 102 and 104, with each gap 228 formed between a pair of light groups 110, so as to cause light groups 110 to be in series connection with one another.

Referring to FIG. 8, a partially closed view of wire stabilizer 108*a* with wire 104 and proximal portion 224 and distal portion 226 of wire 102 in wire channel 204 is depicted. Side-by-side wires 102 and 104 are received by wire channel 204 such that gap 228 is centrally located in channel 204 and aligned such that when wire stabilizer 108*a* is closed, gap-filling projection will fit into gap 228 between proximal end 224 and distal end 226 of wire 102.

Wires 102 and 104 as received by wire channel 204 lie just below a plane formed by surface 190, and when wire stabilizer 108*a* is in a closed position, surfaces 174 and 190 are substantially adjacent and in contact with one another. In other embodiments, wires 102 and 104 may project above a plane formed by surface 190 such that when wire stabilizer 108*a* is in a closed position, surface 174 of top portion 162 contacts a top surface of wires 102 and 104 assisting with the stabilization of the wires.

Referring also to FIG. 5, proximal portions of wires 102 and 104 are adjacent second channel surface 198, distal portions of wires 102 and 104 are adjacent first channel surface 194, and a center portion of wire 104 is adjacent center channel surface 196. An end of proximal portion 224 of wire 102 at gap 228, and an end of distal portion 226 of wire 102 at gap 228 may also contact center channel surface 196. When wire stabilizer 108*a* is in this open position, portions of wire 104 and proximal portion 224 of wire 102 float above second wire-clamping recess 208, and portions of wire 104 and distal portion 226 of wire 102 float above first wireclamping recess 206

Figure 9A:
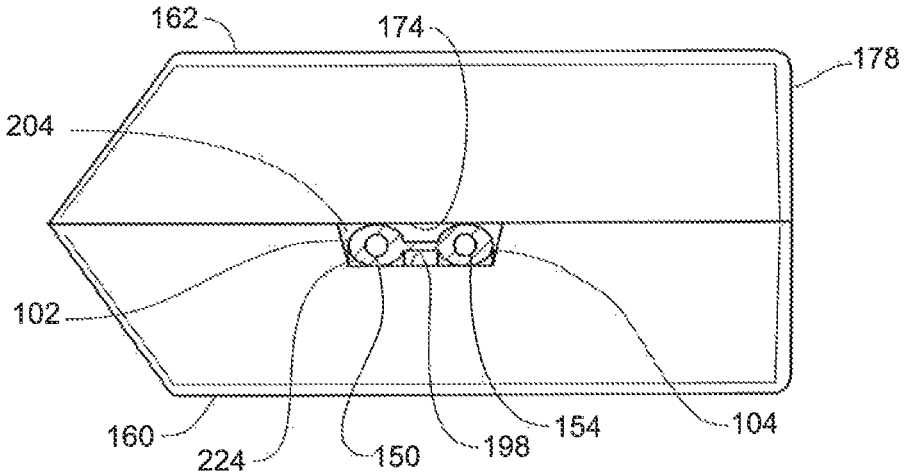
FIG. 9*a* is an end view of the wire and wire stabilizer of FIG. 8, with the wire stabilizer in a closed position.
Figure 9B:
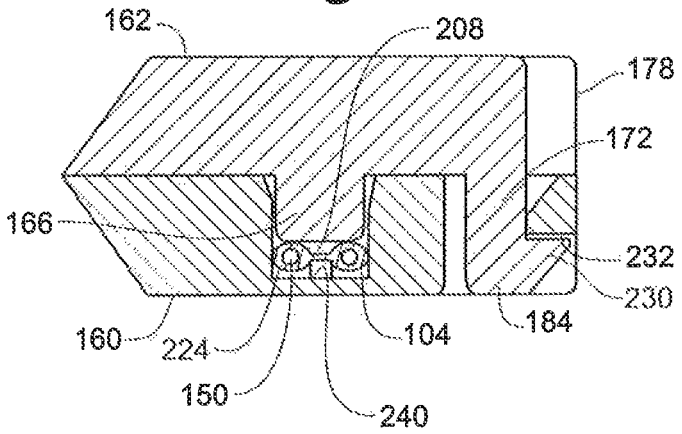
FIG. 9*b* is a sectional view of the wire and wire stabilizer of FIG. 8, with the wire stabilizer in a closed position.

Referring also to FIGS. 9*a* and 9*b*, when top portion 162 is pivoted downward along its hinged connection to bottom portion 160 along axis A, thereby "closing" wire stabilizer 108*a*, gap-filling projection 168 is inserted into gap 228, between gap end 225 of proximal end 224 and gap end 227 of distal end 226. Gap-filling projection 168 comprises a non-conducting material such that portions of 5 the exposed conductor 105 cannot conduct across gap 228 when wire stabilizer 108*a* is closed. Further, inner surface 174 of top portion 162 may apply a downwar force to the center portion of wire 104 adjacent center channel surface 196, thus stabilizing or securing a center portion of wire 104 at the center of wire stabilizer 108*a*.

In an alternate embodiment, wire stabilizer 108*a* does not include gap-filling projection 168. Electrical conduction between ends 225 and 227 of wire 102 is prevented by sizing gap 228 large enough such that under normal operating circumstances, an arc between conductor portions of ends 225 and 227 is unlikely.

Referring specifically to FIG. 9*a*, an end view of wire stabilizer 108*a* enclosing portions of wire 104 and interrupted wire 102 is depicted. When wire stabilizer 108*a* is closed, at proximal end of wires 102 and 104 and wire stabilizer 108*a*, wire 104 and proximal portion 224 of wire 102 is secured or stabilized in channel 204. Inner surface 174 of top portion 162 applies a downward force to top portions of wire 104 and proximal portion 224 of wire 102. Inner surface 198 of bottom portion 160 applies an upward force against bottom portions of wire 104 and proximal portion 224 of wire 102. Consequently, bottom portion 160 and top portion 162 20 may slightly compress wires 102 and 104 to create a compression or friction fit between wires 102 and 104, and wire stabilizer 108*a*. As will be explained further below, the tightness of this fit may vary as wire stabilizer 108*a*. also secures wires 102 and 104 at other points of contact. In an alternate embodiment, inner surface 174 of top portion 162 provides essentially no downward force onto wires 102 and 104.

Although not depicted, when wire stabilizer 108*a* is in the closed position, distal ends of wires 102 and 104 are similarly secured by wire stabilizer 108 in essentially the same manner as proximal ends of wires 102 and 104 are secured by wire stabilizer 108.

Referring also to FIG. 9*b*, a sectional view of wire stabilizer 108*a* enclosing portions of wire 104 and interrupted wire 102 is depicted. When in the fully closed position, first clip projection 170 and its head 182 are received by first clip projection receiver 210. Similarly, second clip projection 172 and its head 184 are received by second clip projection receiver 212.

In an embodiment, each head 182 and 184 includes shoulder 230 that extends transversely and away from it respective projection. When wire stabilizer 108*a* is in the closed position, shoulders 230 are adjacent to, or seated against surfaces 232 of bottom portion 162, thereby securing outside end 178 of top portion 160 to outside end 202 of bottom portion 162 in a snapfit arrangement. In other embodiments of wire stabilizer 108, different structural elements forming different fitments, including other sorts of snap fasteners, clips, friction fits, and so on may be used to accomplish the securing of top portion 160 to bottom portion 162.

Initially, in the open position as depicted in FIG. 8, wires 102 and 104 are seated in channel 204 with a center portion of wire 104 adjacent to center surface 196, proximal portions of wires 102 and 104 are adjacent second channel surface 198, and distal portions of wires 102 and 104 are adjacent first channel surface 194. When wire stabilizer 108*a* is moved to a closed position, first wire-clamping projection 164 contacts a top portion of distal portions of wires 102 and 104, and second wire-clamping projection 166 contacts a top portion. of proximal portions of wires 102 and 104. As bottom and top portions 160 and 162 are brought together to close wire stabilizer 108*a*, first wire-clamping projection 164 applies a downward force to distal portions of wires 102 and 104, bending them about edges 240 and 242, and pushing them into wireclamping recess 206. Likewise, at substantially the same time, second wire-clamping projection 166 applies a downward force to proximal portions of wires 102 and 104, bending them about edges 244 and 246, and pushing them downward into second wire-clamping recess 208.

Generally, the center portion of wire 104 and ends 225 and 227 of wire 102 remain stationary, while portions of distal ends and proximal ends of wires 102 and 104 move towards the center of wire stabilizer 108*a* when other portions of distal and proximal ends of wires 102 and 104 are pushed downward into recesses 206 and 208.

Referring specifically to FIG. 9*b*, a sectional view of wire stabilizer 108*a* securing wires 102 and 104 at a proximal end is depicted. Top portion 162 is securely fitted to bottom portion 160. Second wire-clamping projection 166 contacts a top portion of wire 104 and a top portion of proximal end 224 of wire 102. Bottom portions of wire 104 and proximal end 224 of wire 102 contact a bottom surface 240 of second wire-clamping recess 208, consequently securing another region (in addition to the region adjacent surface 194) of proximal ends of wires 102 and 104.

Distal ends of wires 102 and 104 are similarly secured when first wire-clamping projection 164 contacts a top portion of wire 104 and a top portion of distal end 226 of wire 102, forcing portions of distal ends of wires 102 and 104 into first wire-clamping recess 206.

Consequently, proximal, central and distal portions of wires 102 and 104 are stabilized by wire-stabilizer 108. At proximal ends of wires 102 and 104, the wires are held via friction fits between top inner surface 174 and channel surface 19$, and in wire-clamping recess 208 by second wire-clamping projection 166. At distal ends of wires 102 and 104, the wires are also held via friction fit between top inner surface 174 and channel surface 194, and in wire-clamping recess 206 by first wire-clamping projection 164. Such stabilization wires 102 or 104 from being pulled out of wire stabilizer 108*a*, and possibly exposing portions of conductor 150 at ends 225 and 227 of wire 102, The bending of wires 102 and 104 into recesses 206 and 208 and about edges 240, 242, 244, and 246, respectively, also significantly reduce the possibility of pulling wires 102 and 104 from being dislodged or removed from wire stabilizer 108*a*.

In addition to securing and stabilizing wires 102 and 104, wire stabilizers 108 also prevent conductors 150 at ends 225 and 227 of wire 102 from arcing to each other across gap 228 by providing insulative gap-filling projection 168 between wire ends 225 and 227. Arcing or conduction of ends 225 and 227 to external bodies is also prevented by the surrounding structure of wire stabilizer 108, comprised generally of a non-conducting material such as plastic or other such materials. These isolating and securing features cannot be provided by known socket and base assemblies, including those used with side-by-side wires.

Although the above description refers to a gap 228 created in a wire 102, it will be understood that the above description applies also to gaps 228 created in wires 104. In one embodiment, the embodiment depicted, of wire stabilizer 108, the gapped or interrupted wire will be located so as to line up with gap-filling projection 168. In the depicted embodiment, the wire portion having a gap is generally closer to end 200 of bottom portion 162, while the wire portion that is uninterrupted is located towards the outside end 202 of bottom portion 162, Referring to FIG. 10, steps for assembling an embodiment of light string 100 are depicted. Initially, side-by-side wires 102 and 104 are extended along their lengths.

At step 300, light assemblies 106 are added to wires 102 and 104. As described previously with respect to FIGS. 2*a* to 4, light assemblies 106 are affixed to wires 102 and 104, one lead of each assembly contacting one wire 102 or 104. Light assemblies 106*a* are spaced apart as desired along wires 102 and 104 to form first light group 110*a*. Light group 110*a* comprises a quantity of "N" light assemblies 106*a* as indicated by the N symbol next to light group 110*a* and by the break in wires 102 and 104 between the second and third depicted light assemblies 106*a*. Second light group 110*b* is formed in a manner similar to group 110*a*, with some predetermined distance between first light group 110*a* and second light group 110*b*. A third light group 110*c* is formed in a manner similar to 110*a* and 110*b*. Any number M of light groups 110 may be added to wires 102 and 104, depending in part on available tree voltage and light element voltage (discussed further below). At this point in the assembly process, all light assemblies 106*a*, 106*b*, and 106*c* are electrically connected in parallel.

At step 302, wire portions 226 are removed from wires 102 and 104 to form gaps 228 and to cause light groups 110*a*, 110*b*, and 110*c* to be electrically connected in series, rather than parallel. More specifically, a wire portion 226 is removed from wire 102 between light group 110*a* and light group 110*b*, thereby creating gap 228 and interrupting wire 102 and its conductor 150, between light groups 110*a* and 110*b*. Wire 104 remains continuous between light group 110*a* and light group 110*b*.

A second wire portion 226 is removed from wire 104, and its conductor 154, between light groups 110*b* and 110*c*, thereby creating gap 228 and interrupting wire 104 between light group 110*b* and light group 110*c*. Wire 102 remains continuous between light group 110*b* and light group 110*c*.

This procedure is repeated for the entire subassembly string 302 such that a gap 228 is created between each light group in alternating fashion on wires 102 and 104. As such, for a light string 100 having M light groups 110, a total of M-1 gaps 228 would be created. For odd numbers M, half of the gaps 228 would be at wire 102, and half at wire 104. For even numbers M, one of wires 102 or 104 would have on 5 e more gap 228 than the other. For example, for M=3 light groups, two gaps 228 would he created, one at wire 102 between the first and third light groups, and one at wire 103 between the second and third light groups. Fore M=4, three gaps 228 would be created, two for wire 102, and one for wire 104, or vice versa.

At step 304, wires 102 and 104 are positioned into wire stabilizers 108*a* and 108*b*. Wire 10 stabilizer 108*a* is positioned to receive wires 102 and 104 at first gap 228, which is in wire 102. Wire stabilizer 108*b* is positioned to receive wires 102 and 104 at second gap 118, which is in wire 104. When wire stabilizer 108*a* is the same as wire stabilizer 108*b*, the orientation of wire stabilizers 108*a* and 108*b* are different, such that wire stabilizer 108*b* is rotated 180 degrees such that gap 228 properly aligns with gap filler 168 of wire stabilizer 108 (also refer back to FIG. 8).

At step 306, wire stabilizers 108*a* and 108*b* are closed, consequently locking wires 102 and 104 into place, and creating light string 100.

Figure 10:
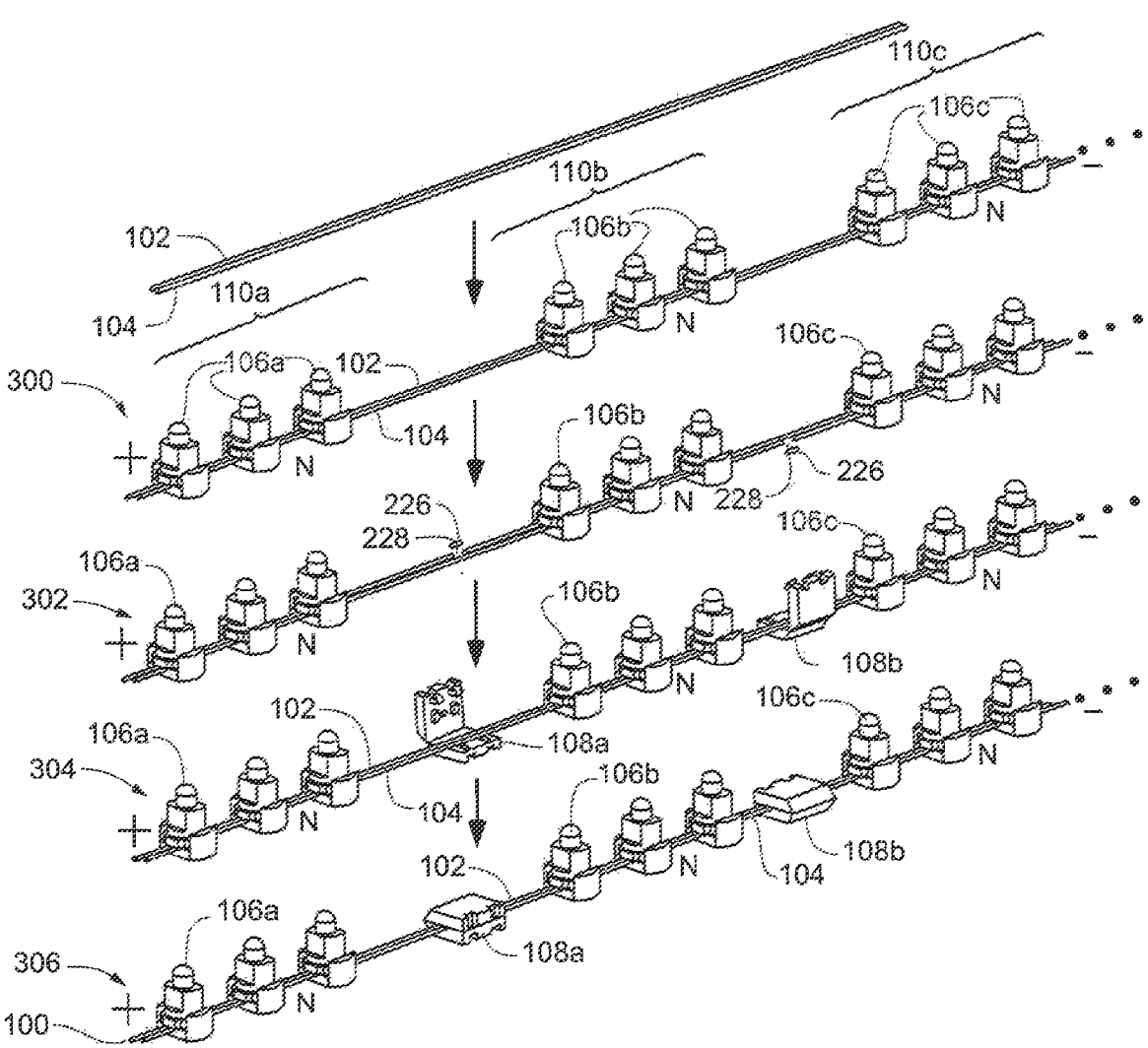
FIG. 10 is a front perspective view of a decorative light string of the present invention depicting multiple stages of assembly.

Although the individual steps 300 to 306 described above refer to each procedure being performed in totality for each light string, e.g., all wire portions 226 punched out to create all gaps 228 in light string 100, then all wire stabilizers 108 positioned with wires 102 and 104, it will be understood that steps 300 to 306 may be performed in other sequences. For example, after a first gap 228 on a wire 102 is created, a wire stabilizer 108 may be added prior to created a second gap. As such, the method steps depicted in FIG. 10 are intended to be illustrative, but not limited to the exact sequence depicted and described.

Figure 11:
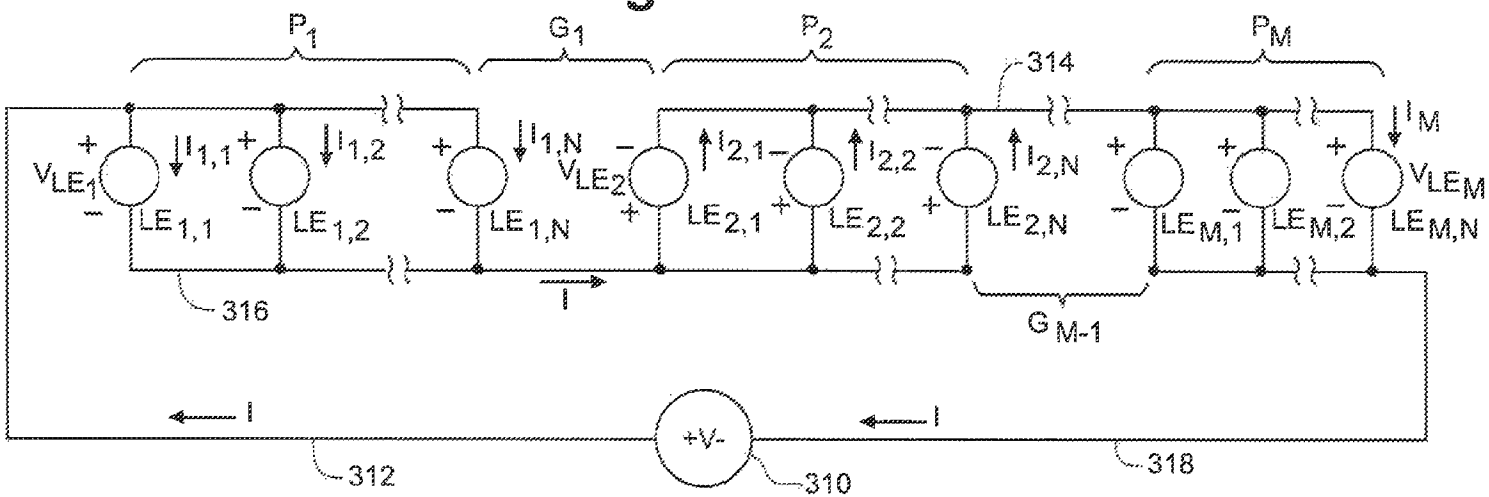
FIG. 11 is a circuit diagram of a light set of the present invention having a layout to depict gaps in the wires of the decorative light string, according to an embodiment.

Referring to FIG. 11, an electrical schematic of light string 100 is depicted. The component layout is depicted so as to illustrate the physical locations of gaps 228 (also referred to by the symbol "G" in FIG. 11).

Light string 100 of FIG. 11 includes a quantity M of parallel light groups P (analogous to light groups 110 described above). The first light group is labeled $P_1$, second light group $P_2$, and last light group $P_M$, Each light group P includes a quantity of N light elements LE, all electrically connected in parallel. Light elements LE within light group $P_1$ are labeled $LE_{1,1}$ to $LE_{1,N}$. Light elements within light group $P_M$ are labeled $LE_{M,1}$, to $LE_{M,N}$. Light groups P are electrically connected in series with one another.

Power source 310 supplies a voltage V to light string 100. Power source 310 may be alternating current (AC) or direct current (DC), and may or may not be supplied through a transformer.

The use of positive and negative symbols indicates the direction of current flow I, positive to negative, as well as a voltage drop, positive to negative, across any particular lighting element LE.

Referring also to FIGS. 1 and 10, electrical paths 312 and 314 correspond to wire 102 of light string 100, gap G1 corresponds to a first gap 228 in wire 102 between first and second light 20 groups 110*a* and 110*b*, Electrical paths 316 and 318 correspond to wire 104, gap GM−1 corresponds to the last gap 228 in wire 104, for example, gap 228 between light groups 110*b* and 110*c* in the case of M=3 light groups.

Electrical path 312 electrically connects power source 310 at a first terminal, which as depicted is a positive terminal, to positive leads, anodes in some embodiments, of each of lighting elements $LE_{P,1}$ to $LE_{P,N}$.

Electrical path 316 connects negative terminals of each of lighting elements LE of group $P_1$. Each lighting element LE of group P1 is electrically connected in parallel, such that each lighting element LE has the same voltage difference or drop across its positive and negative terminals.

Electrical path 316 also connects each positive terminal of lighting elements LE of group $P_2$ to one another, as well as to the negative terminals of lighting elements LE of group $P_1$. Each 10 lighting element LE of group $P_1$ is in parallel to one another. Light group $P_1$ is electrically in series with. light group $P_2$.

Electrical path 314 electrically connects negative terminals or leads of lighting elements of second group P to one another, and to positive terminals of lighting elements of an adjacent light group $P_M$.

Electrical path 318 electrically connects the second terminal of power source 310, which in the depicted embodiment has a negative polarity, to negative leads of each of the last group of lighting elements $LE_{M,1}$ to $LE_{M,N}$ of light group $P_M$.

Figure 12:
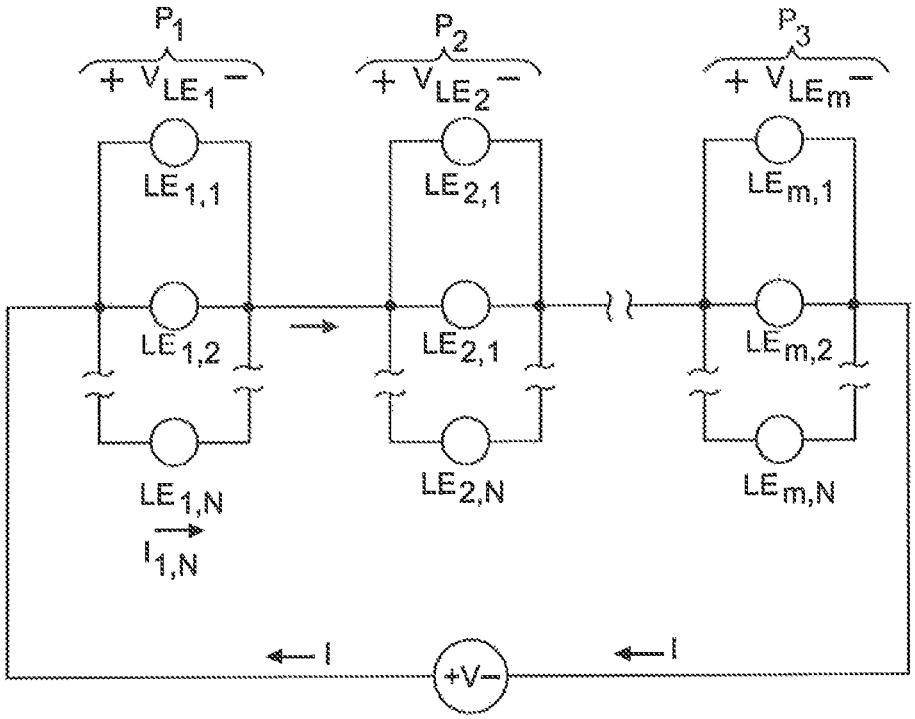
FIG. 12 is another depiction of the circuit diagram of FIG. 11.

Referring also to FIG. 12, this schematic depicts the circuit of light string 100 and of FIG. 11, without attempting to illustrate the physical position of gaps G/gaps 228. This depiction illustrates lighting elements LE positioned in a way that makes the parallel-series nature of light string 100 even more evident.

As will be understood by those skilled in the art, the sum of voltages VLE1 to VLEM add to voltage V. Each lighting element within a lighting group PM has the same voltage VLEM due to the parallel configuration of individual lighting elements LE in the light group. Voltages across lighting elements may vary from light group to light group, depending on desired lighting effects, but most commonly a single type of lighting element LE will be used in light string 100.

Figure 13:
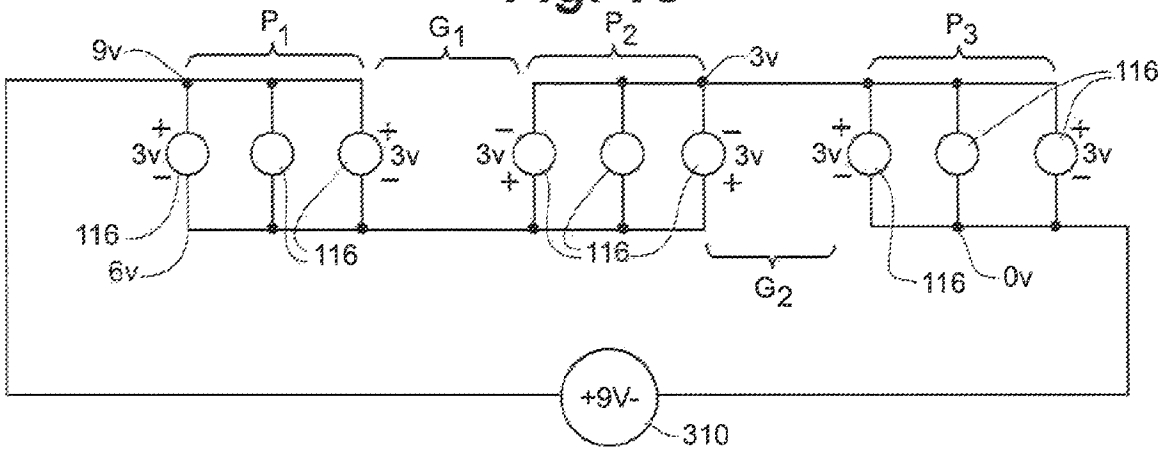
FIG. 13 is a circuit diagram of an exemplary light set of the present invention.

Referring to FIG. 13, a relatively simple schematic of a light string 100 is depicted. In this embodiment, light string 100 includes three light groups, P1, P2, and P3. Each light group has three lighting elements 116 rated for 3V operation. Power source 310 provides 9 VDC. Gap G1 separates light group P1 from P2, and gap G2 separates light group P2 from P3, thus creating a parallel-series circuit from an otherwise purely parallel circuit.

Having lighting elements LE or 116 electrically connected in parallel provides the great advantage that if one lighting element LE in a light group fails, because of the parallel connection, the other light elements will remain lit. In traditional light strings with light elements connected in series, if any lighting element fails, all lighting elements of the series group fail because the electrical path is interrupted by the failure of the single lighting element.

Although parallel light strings are known in the art, the disadvantage of such purely parallel strings is that they generally comprise many, many short lengths of wire, and require a power converter. For example, a purely parallel light string using 3V light elements and powered by a 120 VAC power source requires a significant step down in voltage via a power converter or step down transformer.

One of the advantages of the light string of the present invention, in addition to the simplified construction, is the ability to easily form series connections between parallel groups. In such parallel series configurations, all lighting elements of a single light group must fail before any lighting elements of the other light groups lose power. Light strings assembled to an artificial tree are not easily removed for determining the source of failure, so such a feature provides a great advantage over known light strings applied to artificial trees.

Another advantage to the parallel-series construction of light string 100 is that a smaller power converter requiring less voltage drop is required, or in some cases, no power converter is required. in the embodiment of FIG. 13, a common 3V light element 116 is used in light string 100. If all lighting elements 116 were wired in parallel, a 3V power converter or step-down transformer would be required, rather than a 9V power converter. The "smaller" power converter refers both to physical size as well as capability to reduce voltage and displace heat.

In another example of a light string using a 3V light element and powered by 120 VAC, a power converter is not required if 40 groups of light elements 116 are used. In that particular embodiment, if each light group includes light elements 116, a 400 light parallel-series light string 100 may be constructed that includes the advantages of parallel-series construction as described above. Light strings 100 with a large number of light elements 116, for example, 400, may be awkward to handle for the average consumer, but when assembled at a factory on to an artificial tree with hundreds or thousands of lights, can create both an aesthetic and manufacturing advantage.

Referring to FIGS. 14 to 17, block diagrams of several embodiments of light strings 100 applied to artificial trees to form lighted artificial trees are depicted.

Figure 14:
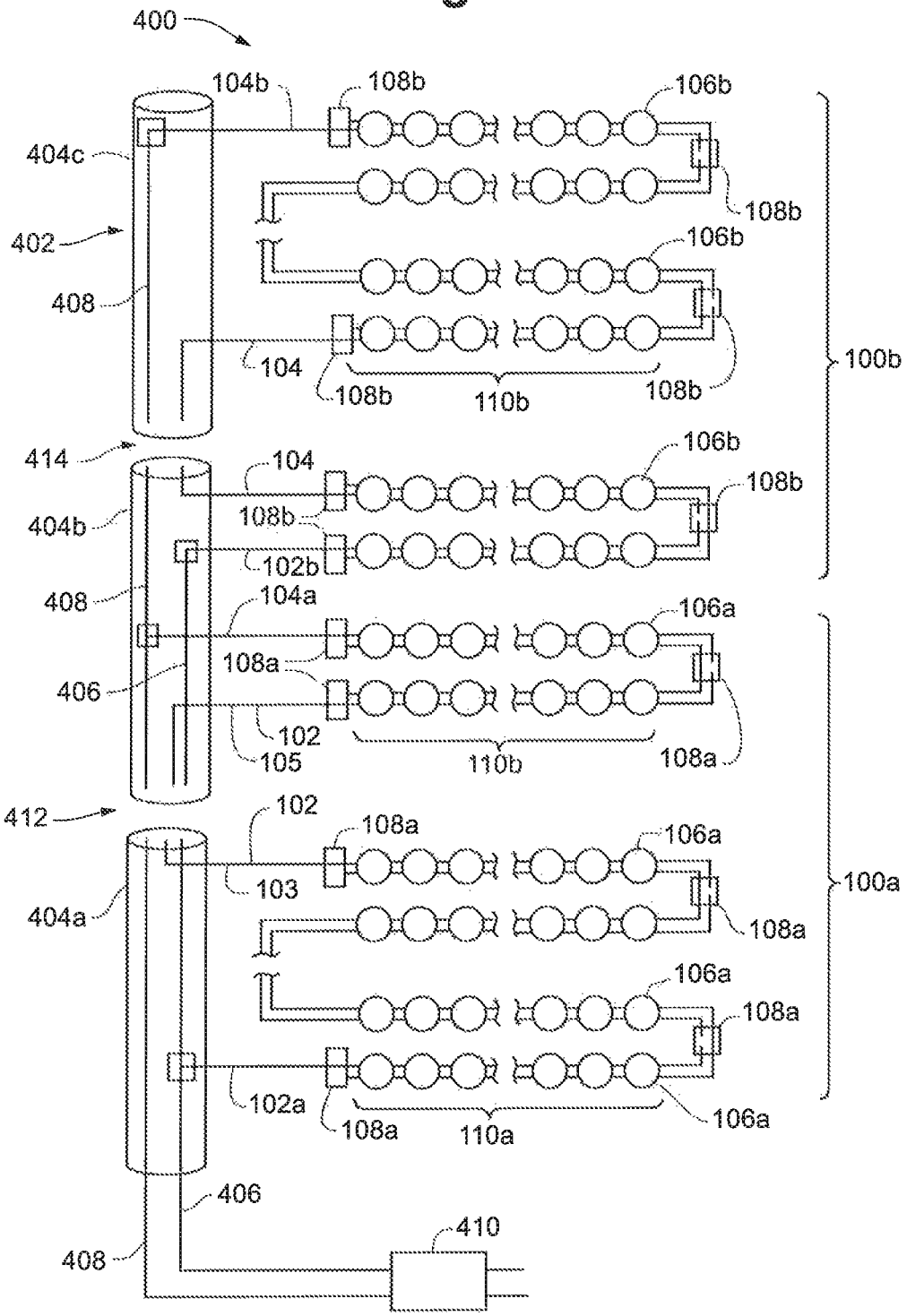
FIG. 14 is a Hock diagram of a lighted artificial tree according to an embodiment of the present invention.

Referring specifically to FIG. 14, an embodiment of lighted artificial tree 400 is depicted. Lighted artificial tree 400 includes artificial tree 402. and a plurality of light strings 100, including light strings 100*a* and 100*b*.

Artificial tree 400 includes trunk 404, first power conductor 406, second power conductor 408 and power plug 410. Although not 5 depicted, artificial tree 402 may also include branches and a base. Light strings 100 may be affixed to the branches, while the base portion supports trunk 404 and tree 402 in an upright position.

Trunk 404 may comprise a single trunk portion, or may be comprised of multiple trunk portions 404*a*, 404*b*, and 404*c* as depicted in the embodiment of FIG. 14. Trunk portions 404*a, b, c* join together mechanically at first joint 412 and second joint 414. In an embodiment, and as depicted, power conductors 406 and 408 extend through one or more trunk sections 404, and electrical connection may be made at the same time as a mechanical connection is made between trunk sections 404. Further details of lighted artificial trees that join together both mechanically and electrically at joints 412 and 414 are found in U.S. Pat. No. 8,454,186, filed May 20, 2011, entitled "Modular Lighted Tree", and commonly assigned to the assignees of the present application, which is herein incorporated by reference in its entirety.

In the embodiment depicted, first power conductor 406 is electrically connected to a first terminal of power plug 410 and extends through trunk section 404*a* and into trunk section 404*b*. Second power conductor 408 is electrically connected to a second terminal of power plug 410 20 and extends upward through all three trunk sections 404*a*, 404*b*, and 404*c*. First and second power conductors 406 and 408 are appropriately sized for the current and power needs of tree 400. In an embodiment, power conductors 406 and 408 comprise a higher gauge wire as compared to the wire gauge of light set 100. In one such embodiment, power conductors 406 and 408 comprise 20 A WG. wires, while light sets 100 comprise 22 A WG wires.

Power plug 410 is configured to plug into a power source to provide power for lighted artificial tree 400. In the depicted embodiment, tree 400 does not include a power transformer.

Light strings 100 for use with artificial trees as described above may include hundreds or more light assemblies 106 or light elements 116/130. As such, light strings 100 may span more than one tree section or trunk portion. In the embodiment of FIG. 14, light string 100*a* spans a lower tree section and a middle tree section. Light string 100*a* spans the middle tree section and an upper tree section. In other embodiments, each tree or trunk section 404 includes only a single light set 100, or multiple light sets 100, none of the light sets spanning a second trunk section 404. Light string 100*a* of tree 400 includes a plurality of light groups 110*a*, each including multiple light assemblies 106*a*. Light groups 110*a* are connected together via wire stabilizers 108*a*. A proximal end of wire 102*a* electrically connects a proximal end of light string 100*a* to first power conductor 406. Proximal end of wire 102*a* may connect to first power conductor 406 at an electrical connector at an outer surface of trunk section 404*a*, or may extend inside trunk section through a trunk wall to couple with first power conductor 406.

A first intermediate portion 103 of wire 102 is directed into trunk portion 404*a* and is electrically connected to second intermediate wire portion 105 of wire 102 through joint 412. As such, at joint 412, an electrical connection is made between lower and middle portions of power conductor 406, power conductor 408, and wire 102. Generally, at a joint 412 or 414 trunk sections 404 are mechanically joined if trunk 402 comprises multiple trunk sections 404, but also, an electrical connection is made between a portion of a power conductors 406 or 408 within one trunk section to a portion of a power conductor 406 or 408 within another trunk section. This allows for continuous power conductors throughout trunk 402 as needed. Also at joint 412 or 414, if a light string 100 spans more than one tree or trunk section, an electrical connection between wire portions of a light string 100 may be made to electrically 5 connect a portion of a light string 100 associated with one tree or trunk section to another portion of the light string 100 associated with a second tree or trunk section.

Second intermediate wire 105 exits trunk section 404*b* to connect to another light group 110*a*. Distal end of wire 104*a* extends from the last, distal light group 110*a* to trunk portion 404*b* and connects with second power conductor 408.

The connection of wires 102 or 104 to power conductors 406 and 408 may be accomplished at a surface or wall of a trunk section, or wires 102 or 104 may extend into a trunk section and connect to power conductors 406 and 408 internally, In other embodiments, rather than penetrate a wall of a trunk section 404, a power conductor 406 or 408, or portions of a light set may enter a trunk section 404 through an end of a trunk section 404. In an embodiment, a wire 102 or 104 extends through a top end of trunk portion 404*c* to connect to a power conductor 406 or 408 (see FIG. 17 also). Connections of wires 102 and 104 to power conductors 406 and 408 may be made using an electrical connector, by soldering, crimping, twisting, or otherwise joining the wires in ways understood by those skilled in the art. The connection of proximal end of wire 102*a* to first power conductor 406, and distal end of wire 104*a* to second power conductor 408 completes the electrical circuit of light string 100*a* and provides power to light assemblies 106*a*.

Wire stabilizers 108*a* are located between each light group 110*a* to secure and isolate wires 102 and 104 as described above in further detail. Wire stabilizers 108*a* are also located at distal and proximal ends of light string, and at intermediate points of light string 100*a*, at locations where either a wire 102 or a wire 104 is terminated. In the depicted embodiment, a wire stabilizer 108*a* stabilizes wires at intermediate wire 103 and an end of a light group 110*a*. Another wire stabilizer 108*a* stabilizes wires at intermediate wire 105 and at a beginning of a subsequent light group 110*a*.

Light string 110*b* spans middle and upper trunk portions 404*b* and 404*c*, connecting to first power conductor 406 at middle trunk portion 404*b* and to second power conductor 408 at upper trunk portion 404*c* to provide power to light string 110*b*. Electrical connections are made between portions of second power conductor 408 and between portions of wire 104 at joint 414.

Although only two light strings 100 are depicted, it will be understood that lighted tree 400 may include any number of light strings 100, dependent upon the overall desired number of lighting assemblies 106, current-carrying capability of power conductors 406 and 408, and so on. Still referring to FIG. 14, in one embodiment of lighted artificial tree 400, each light string 100*a* and 100*b* includes 50 light groups 110, each light group having 10 light assemblies 106, for a total of 500 light assemblies per string 100, or 1,000 per tree. A power source provides 120 VAC power and each light assembly 106 operates at 2.5 VAC. In alternate embodiments, the number of light assemblies 106, or light elements 116/130 may range from 2 20 to 20, with all light groups having the same number of light assemblies 106 per group, or alternatively, light groups having different numbers of light assemblies from group to group.

In another embodiment, lighted artificial tree 400 includes two light strings 100, each light string including 600 lighting assemblies 106. Each light string 100 includes 50 light groups 110 having 12 light elements in parallel. Lighted artificial tree 400 is adapted to receive 120 VAC power and each light element 116 or 130 receives 2.5 VAC.

In yet another embodiment, lighted artificial tree 400 includes two light strings 100. Light string 100*a* includes 600 light elements with 50 light groups 110 with 12 light elements 116 or 130 operating at 2.5 VAC. Light string 110*b* includes 400 light elements with 50 light groups 110 with 8 light elements 116 or 130 operating at 2.5 VAC.

In another embodiment, lighted artificial tree 400 includes two light strings 100. Each light string 100 includes 35 light groups 110 with 10 lighting elements in parallel operating at 3.5V each, the light string 100 powered by 120 VAC. Each light string 100 includes 350 lighting elements, and tree 400 includes 700 lighting elements. In this embodiment, the number of light assemblies may vary from 2 to 30 light elements or light assemblies 106.

In still another embodiment, lighted artificial tree 400 includes two light strings 100, Lighted artificial tree 400 operates on 120 VAC power. First light string 100*a* includes 35 light groups 110 with 10 lighting elements in parallel operating at 3.5 VAC each, or 35 lighting elements 106 for the string. Second light string 100*b* includes 50 light groups 110 with 10 parallel lighting elements 116 or 130 in each group, operating at 2.5 VAC.

In yet another embodiment, lighted artificial tree 400 includes three light strings 100, one per each trunk section 404*a*, 404*b*, and 404*c*. Each light string 100 includes 50 light groups 110 having 10 light assemblies 106 for a total of 500 light assemblies per string, or 1,500 light assemblies 106 and 1,500 light elements 116 or 130 for tree 400. Tree 400 operates on 120 VAC power with 2.5 VAC to each lighting assembly 106.

Figure 15:
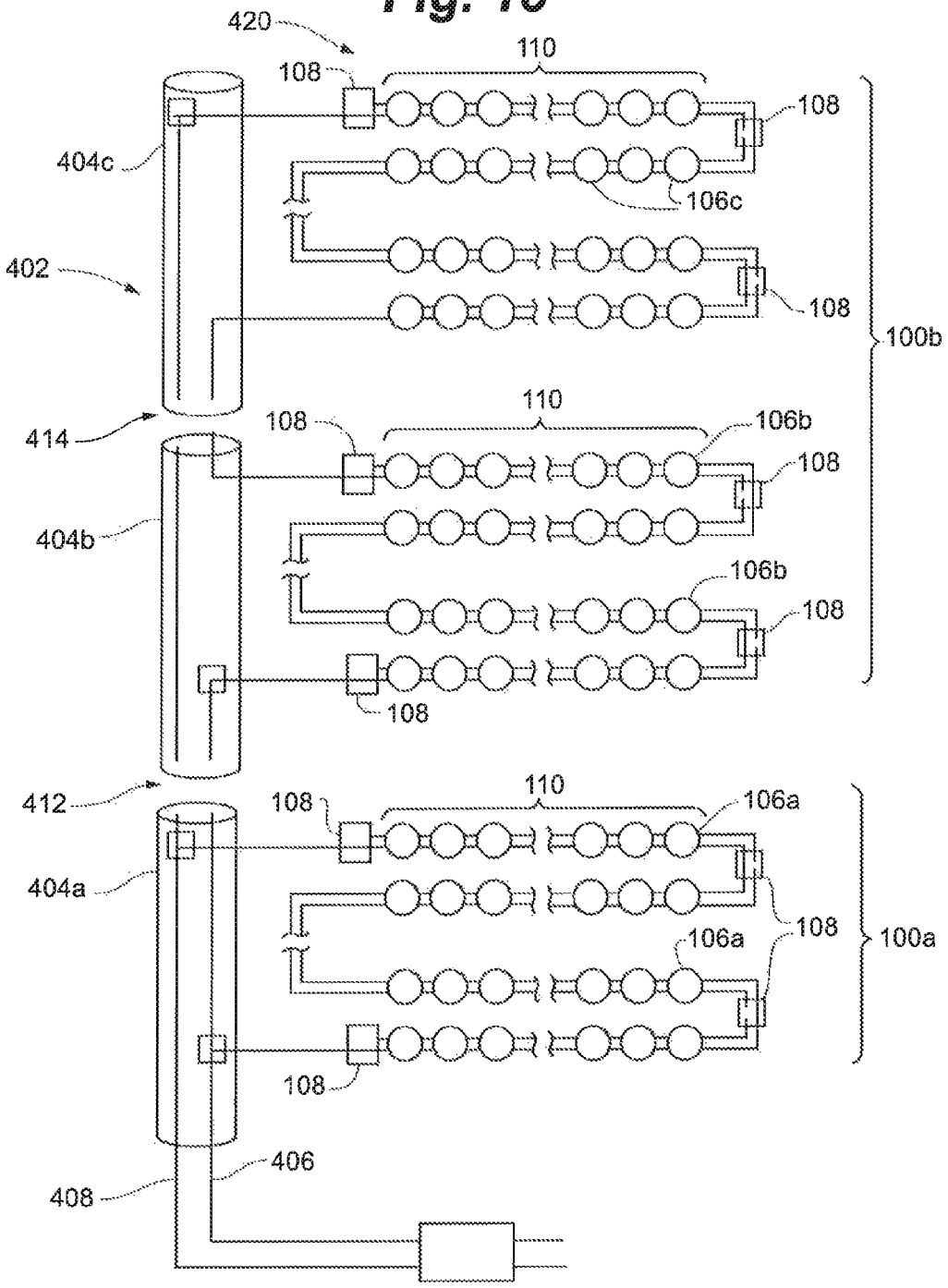
FIG. 15 is a block diagram of a lighted artificial tree according to another embodiment of the present invention.

Referring to FIG. 15, an embodiment of a lighted artificial tree 420 is depicted. This embodiment is substantially similar to the embodiment of lighted artificial tree 400 described above, with the exception that light string 100*a* does not span multiple tree or trunk sections 404, rather is connected only to lower trunk section 404*a*, Light string 100*b* spans the middle and top tree sections, connecting electrically at first power conductor 406 at middle trunk section 404*b* at to second power conductor 408 at top trunk section 404*c*.

In an embodiment of lighted artificial tree 420, light string 100*a* may include fewer light groups 110 and/or fewer light assemblies 106 as compared to light string 100*b*. In one such embodiment, light string 100*a* includes 50 light groups 110 of 10 lighting assemblies 106 each, for a total of 500 light assemblies 106. Light string 100*b* includes 50 light groups 110 of 8 lighting assemblies 106 each, for a total of 400 light assemblies 106.

The ability to vary the length of a light string 100 and the number of light elements 116 or 140 provides great flexibility to accommodate a variety of tree sizes, lighting density, and price point.

Figure 16:
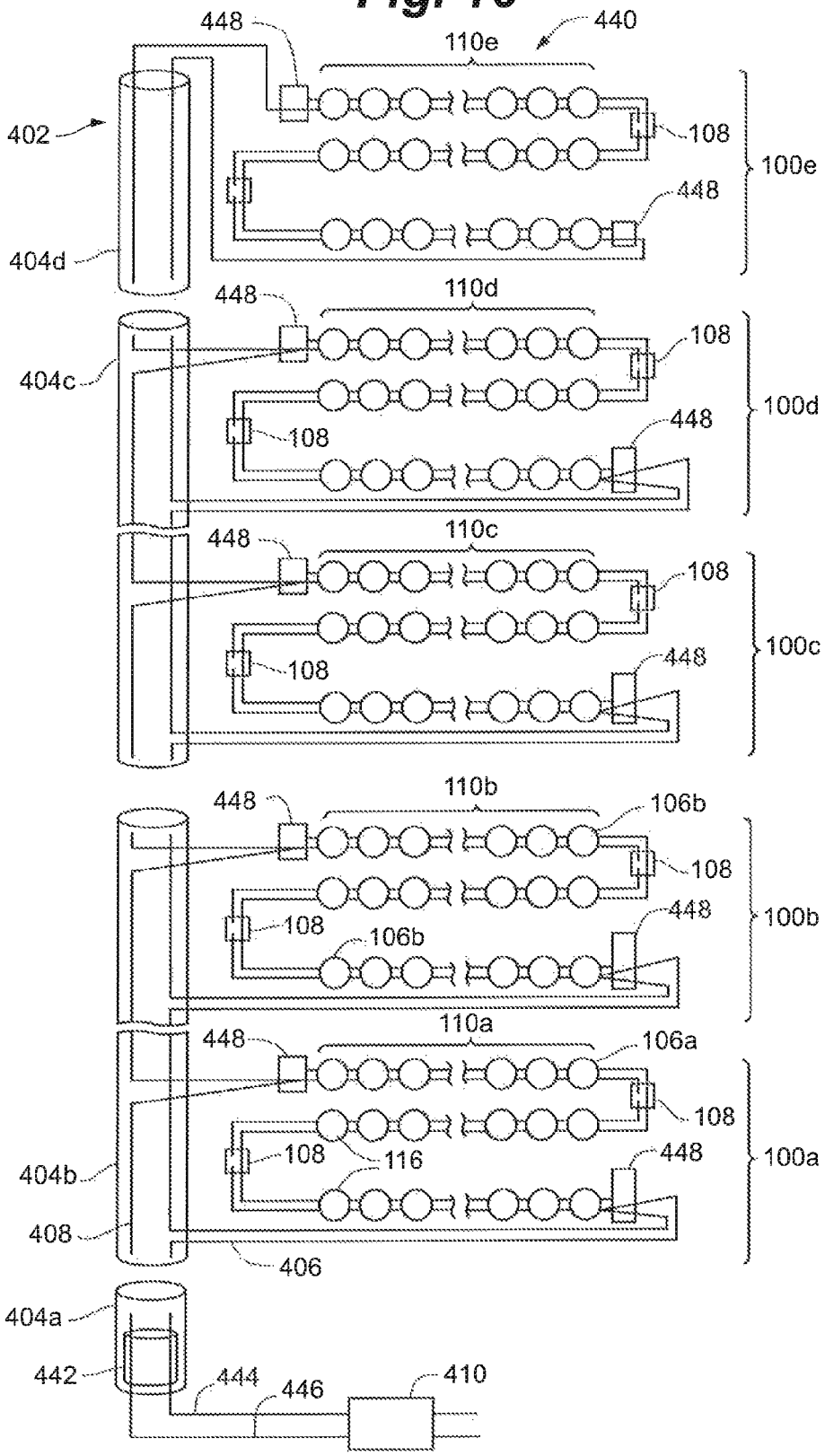
FIG. 16 is a block diagram of a lighted artificial tree according to yet another embodiment of the present invention.

Referring to FIG. 16, a block diagram of lighted artificial tree 440 is depicted. Lighted artificial tree 440 is similar in construction to trees 400 and 420 described above, but also includes power converter 422 located in a portion of trunk 402. Tree 440 also differs from trees 400 and 420 at least with respect to the connections at the ends of light strings 100 to the power bus wires.

In this embodiment, lighted tree 440 includes power converter 442 that converts source power (not depicted) received through power plug 410 and power cord conductors 444 and 446 to tree power. Tree power is available throughout tree 440 via first power conductor 406 and second power conductor 408.

As depicted, power converter 442 may be housed within trunk portion 404*a* so as to improve the appearance of tree 440, and to avoid the inconvenience of having a "wall wart" style power converter that plugs directly into a power outlet. Such known power converters or transformers tend to fall out of wall-mounted outlets, block access to other outlets, and are generally not desirable to view. In one embodiment, transformer 442 is a cylindrical transformer that conforms to the shape of trunk portion 404*a*.

With respect to electrical characteristics, in an embodiment, power converter 442 receives 120 VAC and outputs 9 VDC. In another embodiment power converter 442 receives 120 VAC and outputs 18 VDC. In yet another embodiment, power converter 442 receives 120 VAC and outputs 18 VAC. Nearly any combination of input and output power may he configured as desired.

The choice of power out of power converter 442 along with a desired operating voltage of lighting element 116 or 130, determines the number of light groups 110 in a single light string 100. The number of lighting elements per group 116 or 130 remains unaffected by these factors due to the parallel construction. For example, in the embodiment depicted, power converter 442 receives 120 VAC source voltage and converts it to 9 VDC output voltage. Lighting elements 116 comprise 3 VDC LEDs. Consequently, to provide the desired operating voltage of 3 VDC to each LED 116, three light groups 110 wired in series, with each "dropping" 3 VDC per group, is required. The number of individual LEDs 116 per group is variable, as indicated in FIG. 16.

In other words, the relationship between tree voltage Tv, lighting element voltage Lev and the number of light groups M is Tv=Lev×M. This relationship is independent of the quantity of light elements 116 per light string, though 5 the number of light elements affects total current and power draw of tree 440, and wiring will be sized appropriately.

Still referring to FIG, 16, lighted artificial tree 440 also includes trunk 402 comprising four trunk portions 404*a*, 404*b*, 404*c*, and 404*d*, first power conductor 406, second power conductor 408, and five light strings 100, including light string 100*a*, 100*b*, 100*c*, 100*d*, and 100*e*.

In the embodiment depicted, each light string 100 includes three light groups 110, and any number of parallel connected light assemblies 106 within each group. Wire stabilizers 108 connect light groups 110 within each light string 100. in this embodiment, none of the light strings 100 spans more than one trunk section, primarily because of the lower quantity of light assemblies 106 per string, and the subsequent relatively shorter overall length of light strings 100.

Power conductors 406 and 408 receive power output from power converter 442 as described above. Power conductors 406 and 408 extend upwards through all trunk sections 404 to the top of tree 440, making power available to all light strings 100 distributed throughout tree 440. Unlike power conductors of the above-described embodiments, power conductors 406 and 408 connect to light strings 100 external to trunk 402.

First power conductor 406 exits trunk section 404*b* and connects to first wire 102 at a proximal end of light string 100*a*, and at wire stabilizer 448, providing the positive connection to tree power. Similarly power conductor 408 exits trunk section 404*b* and connects to second wire 104 at a distal end of light string 100*a*, and at another wire stabilizer 448, providing the negative connection to tree power, thus completing the circuit of light string 100.

Wire stabilizers 448 in an embodiment is a modified version of wire stabilizer 108. Wire stabilizer 448 receives an end of a power conductor 406 or 408, an end of a wire 102 and an end wire 104. An electrical connection is made between the power conductor and one of wires 102 or 104. The other of wire 102 or 104 is terminated within, and isolated by, wire stabilizer 448.

In one such embodiment, a first portion of power conductor 106 enters wire stabilizer 44$ and is joined to a second portion of power conductor 106 which exits wire stabilizer 44$ and extends back toward trunk section 404*b*. The first and second portions of first power conductor 106 are joined to and end of wire 102 to form an electrical connection between wire 102 and power conductor 106. Wire stabilizer 448 secures the portions of conductor 406 and wire 102 and isolates them from wire 104 using methods and structures described above with respect to wire stabilizer 108. An end of wire 104 extending from light string 100 is also received by wire stabilizer 448, secured, and isolated from wire 102 and power conductor 406.

Wire stabilizers 448 thusly facilitate the connection of ends of light strings 110 to their respective power conductors throughout lighted artificial tree 440. The use of wire stabilizers 448 to make power connections to light strings 100 external to trunk 402 of tree 440 simplifies assembly of lighted artificial tree 440, especially for trees 440 including relatively higher numbers of light strings 100.

The embodiments above are intended to be illustrative and not limiting. Additional embodiments are within the claims. In addition, although. aspects of the present invention have been described with reference to particular embodiments, those skilled in the art will recognize that changes can be made in form and detail without departing from the spirit and scope of the invention, as defined by the claims.

Persons of ordinary skill in the relevant arts will recognize that the invention may comprise fewer features than illustrated in any individual embodiment described above. The embodiments described herein are not meant to be an exhaustive presentation of the ways in which the various features of the invention may be combined. Accordingly, the embodiments are not mutually exclusive combinations of features; rather, the invention may comprise a combination of different individual features selected from different individual embodiments, as understood by persons of ordinary skill in the art.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed:

1. A modular, lighted artificial tree, comprising:

a first tree section defining a first end and a second end, the first tree section including:

a first cylindrical, hollow trunk portion, a first plurality of branches attached to the first trunk portion, a first and a second power conductor located at least in part within an inside space defined by the first trunk portion, a first light string supported by the branches and having a first plurality of light string wires and a first plurality of light elements, each of the first plurality of light string wires including a conductor portion surrounded by an insulating portion, a first wire electrically connecting the first power conductor to the first light string, the first wire making an electrical connection to the first power conductor within the inside space defined by the first trunk portion, and extending through an opening in a side of the first trunk portion, and making an electrical connection with the first light string outside of the first trunk portion, a second wire electrically connecting the second power conductor to the first light string, the second wire making a connection to the second power conductor within the inside space defined by the first trunk portion, and extending through an opening in a side of the first trunk portion and making a connection with the first light string outside of the first trunk portion, a second tree section defining a first end and a second end, including:

a second cylindrical, hollow trunk portion, a second plurality of branches attached to the second trunk portion, a third and a fourth power conductor located at least in part within an inside space defined by the second trunk portion, a second light string supported by the second plurality of branches and having a second plurality of light string wires and a second plurality of light elements, each of the first plurality of light string wires including a conductor portion surrounded by an insulating portion, a third wire electrically connecting the third power conductor to the second light string, the third wire making a connection to the third power conductor within the inside space defined by the second trunk portion, and extending through an opening in a side of the second trunk portion, and making a connection with the second light string outside of the second trunk portion, a fourth wire electrically connecting the fourth power conductor to the second light string, the fourth wire making a connection to the fourth power conductor within the inside space defined by the second trunk portion, and extending through an opening in a side of the second trunk portion and making a connection with the second light string outside of the second trunk portion;

wherein the first end of the second tree section is configured to mechanically and electrically connect to the second end of the first tree section such that the first power conductor is electrically connected to the third power conductor, the second power conductor is electrically connected to the fourth power conductor.

2. The modular, lighted artificial tree of claim 1, wherein the opening in the side of the first trunk portion through which the first wire extends is the same opening through which the second wire extends.

3. The modular, lighted artificial tree of claim 1, wherein the first wire is connected to the first light string by an electrical connector.

4. The modular, lighted artificial tree of claim 1, wherein the first wire is connected to the first power conductor by an electrical connector and the second wire is connected to the second power conductor by a solder connection.

5. The modular, lighted artificial tree of claim 1, wherein the first tree section includes only one light string connected to the first and second power conductors, the one light string connected to the first and second power conductors by the first and second wires extending through only one opening in the side of the first trunk portion.

6. The modular, lighted artificial tree of claim 1, wherein the first light string includes light elements wired in series.

7. The modular, lighted artificial tree of claim 1, wherein the first light string includes light elements wired in parallel and in series.

8. A modular, lighted artificial tree, comprising:

a first tree section defining a first end and a second end, the first tree section including:

a first cylindrical, hollow trunk portion, a first plurality of branches attached to the first trunk portion, a first and a second power conductor located at least in part within an inside space defined by the first trunk portion, a first light string supported by the branches and having a first plurality of light string wires and a first plurality of light elements, each of the first plurality of light string wires including a conductor portion surrounded by an insulating portion, a first wire electrically connecting the first power conductor to the first light string, the first wire making an electrical connection to the first power conductor within the inside space defined by the first trunk portion, and extending through an opening in a side of the first trunk portion, and making an electrical connection with the first light string outside of the first trunk portion, a second wire electrically connecting the second power conductor to the first light string, the second wire making a connection to the second power conductor within the inside space defined by the first trunk portion, and extending through the opening in the side of the first trunk portion and making a connection with the first light string outside of the first trunk portion, a second tree section defining a first end and a second end, including:

a second cylindrical, hollow trunk portion, a second plurality of branches attached to the second trunk portion, a third and a fourth power conductor located at least in part within an inside space defined by the second trunk portion, a second light string supported by the second plurality of branches and having a second plurality of light string wires and a second plurality of light elements, each of the first plurality of light string wires including a conductor portion surrounded by an insulating portion, a third wire electrically connecting the third power conductor to the second light string, the third wire making a connection to the third power conductor within the inside space defined by the second trunk portion, and extending through an opening in a side of the second trunk portion, and making a connection with the second light string outside of the second trunk portion, a fourth wire electrically connecting the fourth power conductor to the second light string, the fourth wire making a connection to the fourth power conductor within the inside space defined by the second trunk portion, and extending through the opening in the side of the second trunk portion and making a connection with the second light string outside of the second trunk portion;

wherein the first end of the second tree section is configured to mechanically and electrically connect to the second end of the first tree section such that the first power conductor is electrically connected to the third power conductor, the second power conductor is electrically connected to the fourth power conductor, and the first tree section includes only one light string connected to the first and second power conductors through the opening in the side of the first trunk portion, the second tree section includes only one light string, and the first light string includes more light elements than the second light string.

9. The modular, lighted artificial tree of claim 8, wherein a light element operating voltage of each of the first plurality of light elements is the same as the light element operating voltage of each of the second plurality of light elements.

10. The modular, lighted artificial tree of claim 8, wherein all of the light elements of the first light string are electrically connected in parallel.

11. The modular, lighted artificial tree of claim 8, wherein the first light string comprises two groups of light elements, each group having from 2 to 20 light elements, the first group of light elements electrically connected to one another, the second group of light elements electrically connected to one another.

12. The modular, lighted artificial tree of claim 8, wherein the first light string includes light elements wired in parallel and in series.

13. The modular, lighted artificial tree of claim 8, further comprising a power converter configured to convert an incoming alternating current (AC) voltage to a direct current (DC) voltage, the DC voltage being less than the AC voltage.

14. The modular, lighted artificial tree of claim 13, wherein an operating voltage of each of the light elements of the first plurality of light elements and the second plurality of light elements is less than the DC voltage of the power converter.

15. A modular, lighted artificial tree, comprising:

a power converter configured to convert an incoming alternating current (AC) voltage to a direct current (DC) voltage, the DC voltage being less than the AC voltage;

a first tree section defining a first end and a second end, the first tree section including:

a first cylindrical, hollow trunk portion defining an inside space, a first plurality of branches attached to the first trunk portion, a first and a second power conductor located at least in part within an inside space defined by the first trunk portion, and in electrical connection with the power converter so as to receive the DC voltage of the power converter, a first light string supported by the branches and having a first plurality of light string wires and a first plurality of light assemblies, the wires having a conductor portion surrounded by an insulating portion, the first plurality of light assemblies including a first group of light elements and a second group of light elements, the light elements of the first and second groups of light elements comprising light-emitting diodes operating at a first operating voltage, a first wire electrically connecting the first power conductor to the first light string, the first wire making an electrical connection to the first power conductor within the inside space defined by the first trunk portion, and extending through an opening in a side of the first trunk portion, and making an electrical connection with the first light string outside of the first trunk portion, a second wire electrically connecting the second power conductor to the first light string, the second wire making an electrical connection to the second power conductor within the inside space defined by the first trunk portion, and extending through an opening in a side of the first trunk portion and making the electrical connection with the first light string outside of the first trunk portion, a second tree section defining a first end and a second end, the second end of the second tree section mechanically and electrically connectable to the first end of the first tree section, the second tree section including:

a second cylindrical, hollow trunk portion defining an inside space, a second plurality of branches attached to the second trunk portion, a third and a fourth power conductor located at least in part within the inside space defined by the second trunk portion, a second light string supported by the second plurality of branches and having a second plurality of light string wires and a second plurality of light assemblies, the second plurality of light assemblies including a first group of light elements and a second group of light elements, the light elements of the first and second groups of light elements operating at a second light element operating voltage, a third wire electrically connecting the third power conductor to the second light string, the third wire making an electrical connection to the third power conductor within the inside space defined by the second trunk portion, and extending through an opening in a side of the second trunk portion, and making an electrical connection with the second light string outside of the second trunk portion, a fourth wire electrically connecting the fourth power conductor to the second light string, the fourth wire making an electrical connection to the fourth power conductor within the inside space defined by the second trunk portion, and extending through an opening in a side of the second trunk portion and making the electrical connection with the second light string outside of the first trunk portion;

wherein a total quantity of light elements of the first tree section is greater than a total number of light elements of the second tree section, the first plurality of light assemblies includes more light elements than the second plurality of light elements, the first light element operating voltage is equal to the second light element operating voltage, and the first light element operating voltage and second operating voltage are both less than the DC voltage of the power converter.

16. The modular, lighted artificial tree of claim 15, wherein the opening in the side of the first trunk portion through which the first wire extends is the same opening through which the second wire extends.

17. The modular, lighted artificial tree of claim 15, wherein the first wire is connected to the first light string by an electrical connector.

18. The modular, lighted artificial tree of claim 15, wherein the first tree section includes only one light string connected to the first and second power conductors, the one light string connected to the first and second power conductors by the first and second wires extending through only one, common opening in the side of the first trunk portion.

19. The modular, lighted artificial tree of claim 15, wherein the first light string includes light elements wired in series.

20. The modular, lighted artificial tree of claim 15, wherein the first light string includes light elements wired in parallel and in series.

* * * * *